US010080444B2

(12) United States Patent
Whitman

(10) Patent No.: US 10,080,444 B2
(45) **Date of Patent: *Sep. 25, 2018**

(54) FOLDING PLAYPEN AND DUAL SLEEPER

(71) Applicant: CAPPYBUG, LLC, St. Augustine, FL (US)

(72) Inventor: Ashley Waters Whitman, St. Augustine, FL (US)

(73) Assignee: CAPPYBUG, LLC, St. Augustine, FL (US)

( * ) Notice: Subject to any disclaimer, the term of this patent is extended or adjusted under 35 U.S.C. 154(b) by 287 days.

This patent is subject to a terminal disclaimer.

(21) Appl. No.: 14/851,581

(22) Filed: Sep. 11, 2015

(65) Prior Publication Data

US 2016/0000234 A1 Jan. 7, 2016

Related U.S. Application Data

(63) Continuation-in-part of application No. 14/019,778, filed on Sep. 6, 2013, now Pat. No. 9,155,402.

(Continued)

(51) Int. Cl.

| | |
|---|---|
| ***A47D 13/06*** | (2006.01) |
| ***A47D 13/00*** | (2006.01) |
| ***A47D 7/00*** | (2006.01) |

(52) U.S. Cl.

CPC ..... *A47D 13/063* (2013.01); *A47D 13/061* (2013.01); *A47D 7/002* (2013.01)

(58) Field of Classification Search

CPC ..... A47D 7/00; A47D 7/002; A47D 7/005; A47D 9/00; A47D 9/005; A47D 11/00; A47D 11/005; A47D 11/007; A47D 13/06; A47D 13/061; A47D 13/063; A47D 13/065; A47D 13/066; A47D 13/068

(Continued)

(56) References Cited

U.S. PATENT DOCUMENTS 3,040,341 A * 6/1962 Hesketh ..... A47D 13/063 5/99.1
3,485,287 A * 12/1969 Milbourne, Sr. ..... E06B 3/481 160/183

(Continued)

FOREIGN PATENT DOCUMENTS

EP 0295761 A2 * 12/1988 ..... A47D 13/063
EP 2923613 A1 * 9/2015 ..... A47D 13/063

*Primary Examiner* — Robert G Santos

(74) *Attorney, Agent, or Firm* — Glenn E. Gold; Glenn E. Gold, P.A.

(57) ABSTRACT

A folding playpen has a frame assembly including a plurality of parallel uprights arranged in a geometric configuration and a plurality of upper rails pivotally affixed to and extending between a top portion of adjacent ones of the uprights. A co-planar grid of braces extends between said the uprights and includes a central support block at a center of geometrically configured uprights. The braces pivotally attached to the central support block and to a respective one of the uprights. A flexible covering extends about a periphery of the frame assembly and a pad is supported by the co-planar grid. The frame assembly is selectively collapsible from a usable configuration to a storage configuration by vertically translating the central support block from a lower position to a position proximate to a top of the uprights.

24 Claims, 18 Drawing Sheets

Related U.S. Application Data

(60) Provisional application No. 61/700,931, filed on Sep. 14, 2012.

(58) Field of Classification Search
USPC ..... 5/93.1, 93.2, 98.1, 99.1
See application file for complete search history.

(56) References Cited

U.S. PATENT DOCUMENTS 4,811,437 A * 3/1989 Dillner ..... A47D 13/063 5/93.1
5,697,111 A * 12/1997 Dillner ..... A47D 13/063 5/93.1
6,349,434 B1 * 2/2002 Zhuang ..... A47D 13/063 5/98.1
6,539,563 B1 * 4/2003 Hsia ..... A47D 7/04 248/150
7,346,943 B2 * 3/2008 Chen ..... A47D 7/03 5/416
7,509,694 B2 * 3/2009 Chen ..... A47D 7/03 5/416
8,006,326 B2 * 8/2011 Thomas ..... A47D 5/00 5/93.1
8,316,483 B2 * 11/2012 Thomas ..... A47D 5/00 256/25
8,677,527 B2 * 3/2014 Hartenstine ..... A47D 9/005 5/93.1
9,155,402 B1 * 10/2015 Whitman ..... A47D 7/002
9,661,938 B2 * 5/2017 Hung ..... A47D 13/063
2003/0070230 A1 * 4/2003 Hsia ..... A47D 7/04 5/95
2006/0218725 A1 * 10/2006 Carpenter ..... A47D 7/04 5/93.1
2006/0236454 A1 * 10/2006 Chen ..... A47D 7/03 5/93.1
2008/0086813 A1 * 4/2008 Chen ..... A47D 7/03 5/93.1
2008/0209631 A1 * 9/2008 Thomas ..... A47D 5/00 5/99.1
2011/0266509 A1 * 11/2011 Thomas ..... A47D 5/00 256/25
2012/0037868 A1 * 2/2012 Hartenstine ..... A47D 9/005 256/25
2015/0272343 A1 * 10/2015 Hung ..... A47D 13/063 5/99.1
2016/0000234 A1 * 1/2016 Whitman ..... A47D 13/063 5/99.1
2017/0280892 A1 * 10/2017 Zhang ..... A47D 13/063

* cited by examiner

FOLDING PLAYPEN AND DUAL SLEEPER

CROSS-REFERENCE TO RELATED APPLICATION

This Non-Provisional Utility application is a continuation application which claims the benefit of co-pending U.S. non-provisional application Ser. No. 14/019,778, having a filing date of Sep. 6, 2013, which claims the benefit of U. S. Provisional Patent Application Ser. No. 61/700,931, filed on Sep. 14, 2012. These cited applications are incorporated-by-reference herein in their entirety.

FIELD OF THE INVENTION

The present disclosure generally relates to children's playpen, and more particularly to a folding playpen.

BACKGROUND OF THE INVENTION

A playpen is a piece of furniture in which an infant or young toddler (typically those less than thirty-five inches tall and weighing less than thirty pounds) is placed to prevent self-harm when the child's parent or guardian is occupied or unable to maintain a constant watch over the young child.

Playpens have been utilized by parents for many years and were traditionally made of wood. Early playpens had a flat rectilinear platform, most usually square, and had four sides comprising a plurality of regularly spaced vertical bars extending from a top rail to the bottom platform. This configuration allows the child to see out, but the horizontal spacing of the vertical bars are such to prevent the child from exiting the playpen. The floor of the playpen, the rectilinear platform, is covered with a soft mat for the child's comfort. The vertical barred walls of the playpen are usually higher than the height of the child to prevent injuries from children attempting to climb over the walls. Playpens may also have a detachable lid.

Current playpens have more modern and portable designs and typically comprise a basic metal and plastic support system with mesh, soft plastic or nylon sides extending between the rigid members of the support system. Some playpens include an optional removable bassinet that can be attached at the top in which the child can sleep or utilized to change diapers until the child is a few months of age. Some models of playpens have attachments such as mobiles, side pockets for supplies and toys, and a clip-on adapter to retain an electronic device for playing music so the child can listen to the music while sleeping or playing. Portable playpens are available in different sizes, but most can be collapsed into a small roll for easy storage and transport. However, these portable playpens can be difficult to collapse or disassemble into their compact collapsed state for transport.

Additionally, many families have multiple small children. For example, it is not uncommon for a family to have an infant and a toddler, or a newborn and an infant. Unfortunately, with playpens of the prior art, this usually requires the purchase or acquisition of a multitude of playpens, at least one for each child, as it can be a safety hazard to place a multitude of children of varying ages in one single playpen.

Accordingly, there remains a need in the art for a folding playpen that can be quickly collapsed into a single compact unit for transport and also easily expanded for use. In addition, there remains a need in the art for a folding playpen that can be safely used with more than one child.

SUMMARY OF THE INVENTION

The present disclosure is generally directed to a folding playpen that satisfies the need for a portable playpen that is easily collapsed into a single compact unit for transport and easily expanded for use.

The folding playpen includes a first rectilinear end frame and a second rectilinear end frame of like size to the first rectilinear end frame and substantially parallel thereto. An extendable scissors mechanism has one end affixed to a bottom of the first rectilinear end frame and a second end affixed to a bottom of the second rectilinear end frame for translating the end frames one with respect to the other between a collapsed configuration and an extended configuration. A flexible plastic mesh extends about a periphery of the first and said second end frames in their extended configuration. A removable bottom pad is inserted over the scissors mechanism when the first and second end frames are in their extended configuration.

In a second aspect, a folding playpen includes a frame assembly selectively collapsible from an extended configuration to a storage configuration. The frame assembly has a plurality of parallel uprights arranged in a geometric configuration and a co-planar grid extending between the plurality of uprights. A flexible covering extends about a periphery of the frame assembly and is selectively removable therefrom. A central divider is selectively extendable between opposing sides of the flexible covering to separate an interior of the playpen into multiple areas. A pad is supported by the co-planar grid.

In another aspect, the central divider extends substantially from a top to a bottom of opposing playpen sides and is selectively attachable to opposing playpen sides in a vertical orientation.

In yet another aspect, the central divider comprises selectively separable panels affixed to opposing sides of said playpen. The panels have fastener portions at ends opposite from the playpen sides and fastened one to the other to divide an interior of the playpen into at least two interior portions.

In yet another aspect, the fastener portions are selected from a group consisting of hook and loop, snap, zipper, and button fasteners.

In yet another aspect, the opposing sides of the playpen each include a tab affixed thereto. The tab extends substantially from a top to a bottom thereof, each tab including fastener portions affixed thereto. The central divider is selectively removable from the playpen interior and has tabs extending from a top to a bottom of opposite ends thereof and including fastener portions on the tabs. The tabs being engaged with the fastener portions on the tabs affixed to the sides of the playpen.

In yet another aspect, the fastener portions are selected from a group consisting of hook and loop, snap, zipper, and button fasteners.

In a further aspect, a folding playpen has a frame assembly having a plurality of parallel uprights arranged in a geometric configuration and a plurality of upper rails pivotally affixed to and extending between a top portion of adjacent ones of the uprights. A co-planar grid extends between the plurality of uprights and includes a central support block having a leg extending downwardly therefrom is substantially positioned at a center of the geometrically configured uprights. A cross brace extends from each upright to the central support block, each cross brace pivotally attached to the central support block and to a respective one of the uprights. A flexible covering extends about a periphery of the frame assembly. A central divider is selectively extendable between opposing sides of the flexible covering to divide an interior of the playpen into multiple areas. A pad is supported by the co-planar grid. The frame assembly is selectively collapsible from an extended configuration to a storage configuration by vertically translating the central support block from a lower position to a position proximate to a top of the uprights.

In yet another aspect, the playpen further including a corner support received at a bottom portion of each upright wherein a respective one of the cross braces is pivotally affixed to the corner support.

In yet another aspect, the co-planar grid further includes a plurality of intermediate braces, each intermediate brace extends between adjacent ones of the cross braces intermediate between the central support block and a respective one of the uprights.

In yet another aspect, each intermediate brace is pivotally attached to respective ones of the cross braces, and further wherein each intermediate brace includes a central hinge such that the intermediate brace can be selectively folded upon itself.

In yet another aspect, each intermediate brace is pivotally attached to a brace fitting at respective ones of the cross braces, the brace fittings being freely translatable along a length of the cross braces.

In yet another aspect, the co-planar grid further includes between each of adjacent ones of the cross braces, a secondary support block having a leg extending downwardly therefrom and a pair of intermediate support braces, a first of the intermediate support braces is pivotally attached to a first of the adjacent cross braces and the secondary support block and a second of the intermediate support braces is pivotally attached to a second of the adjacent cross braces and the secondary support block.

In yet another aspect, each intermediate brace at an end opposite from the secondary support block is pivotally attached to a brace fitting at respective ones of the cross braces, the brace fittings being freely translatable along a length of the cross braces.

In yet another aspect, the flexible covering wherein the central divider comprises a first panel affixed to a first interior side of the flexible covering and a second panel affixed to an opposite second interior side of the flexible covering, the first and the second panels selectively attachable one to the other for dividing an interior of the playpen.

In yet another aspect, the opposing sides of the playpen each include a tab affixed thereto. The tab extends substantially from a top to a bottom thereof, each tab including fastener portions affixed thereto. The central divider is selectively removable from the playpen interior and has tabs extending from a top to a bottom of opposite ends thereof and including fastener portions on the tabs. The tabs being engaged with the fastener portions on the tabs affixed to the sides of the playpen.

In yet another aspect, a folding playpen has a frame assembly having a plurality of parallel uprights arranged in a geometric configuration and a plurality of upper rails pivotally affixed to and extending between a top portion of adjacent ones of the uprights. A corner support is affixed to a bottom portion of each upright. A co-planar grid extends between the plurality of uprights and includes a central support block substantially positioned at a center of the geometrically configured uprights. A cross brace extends from each corner support to the central support block, each cross brace pivotally attached to the central support block and to a respective one of the corner supports. A flexible covering extends about a periphery of the frame assembly. A central divider is selectively extendable between opposing sides of the flexible covering to divide an interior of the playpen into multiple areas. A pad is supported by the co-planar grid. The frame assembly is selectively collapsible from an extended configuration to a storage configuration by vertically translating the central support block from a lower position to a position proximate to a top of the uprights.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
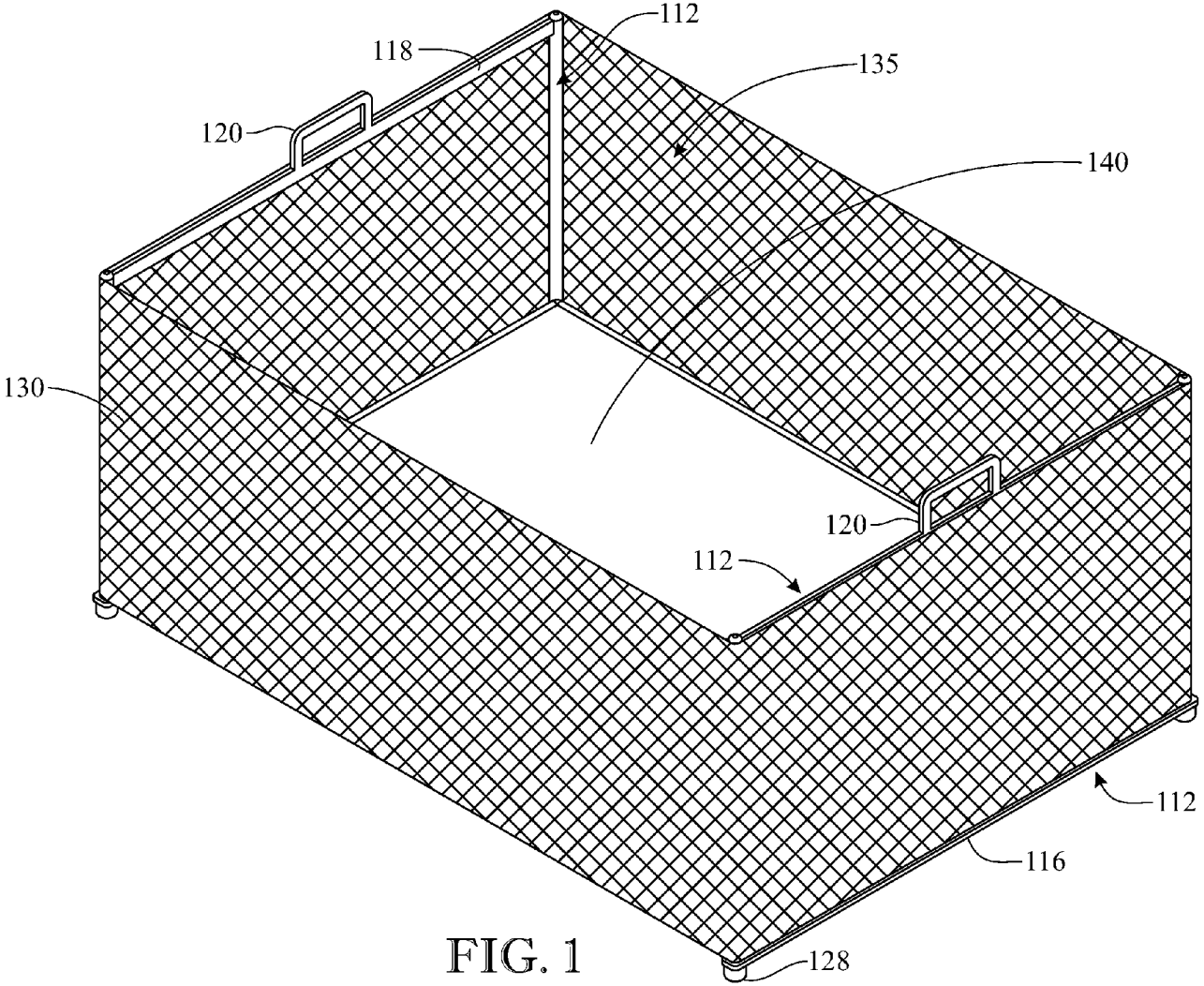
FIG. 1 presents a top isometric view of a folding playpen with the floor pad installed in the bottom of the playpen in an expanded configuration.

In one exemplary implementation of the invention, a folding playpen 100 is shown in FIG. 1 where the playpen 100 includes two substantially identical rectilinear end frames 112 laterally separated one from the other, a co-planar grid 122 interconnecting the rectilinear end frames 112 proximate bottom ends thereof, and a flexible mesh 130 extending about a rectilinear perimeter defined by the two rectilinear end frames 112 and the co-planar grid 122 so as to form a rectilinear play area or interior 135 of the playpen 100 defined by the flexible covering or mesh 130. The playpen 100 also includes a removable bottom pad 140, being separate from the flexible covering or mesh 130, on which a child may sit, rest, or play. The playpen 100 is supported above the floor level on which it rests by a plurality of support feet 128 that are typically formed of a resilient material to prevent slippage on a smooth floor surface and to prevent the playpen 100 from scratching the floor surface.

Figure 2:
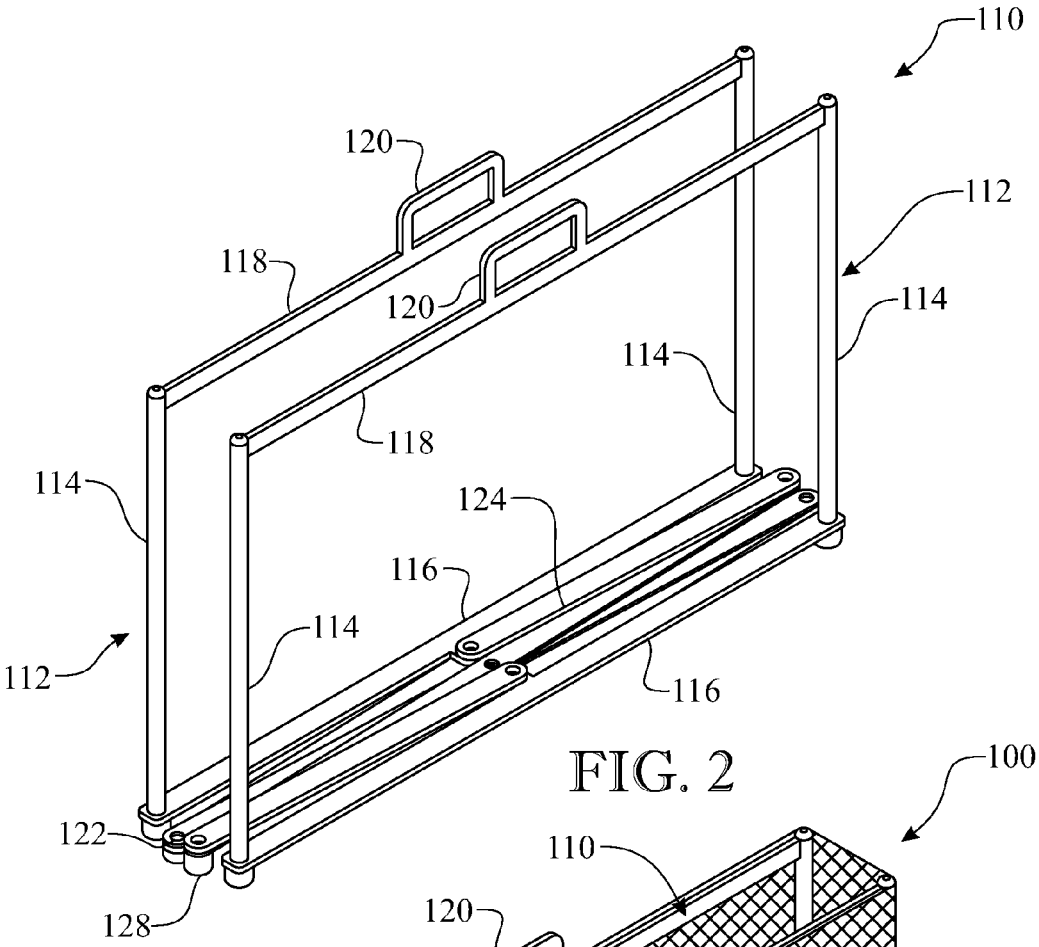
FIG. 2 presents an isometric view of a playpen frame of the playpen, originally introduced in FIG. 1, in a collapsed configuration.
Figure 6:
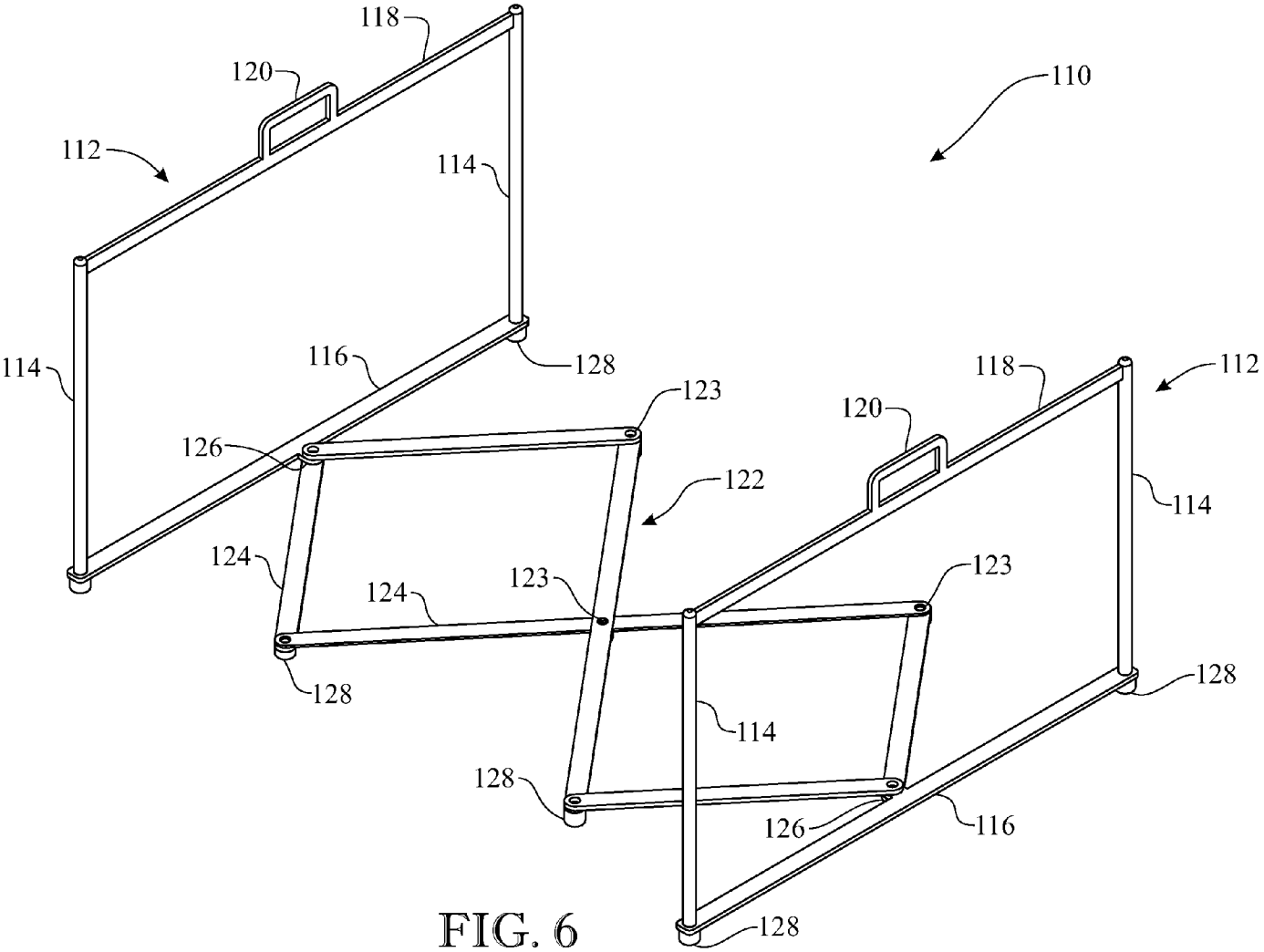
FIG. 6 presents a top isometric view of the playpen frame of the playpen, originally introduced in FIG. 1, in its expanded configuration.

As best shown in FIG. 2 with the flexible mesh 130 removed for clarity, the two rectilinear end frames 112 and the co-planar grid in the form of a contractible and extendable scissors mechanism 122 interconnecting the rectilinear end frames 112 form a frame assembly 110 of the playpen 100 that is convertible between a collapsed configuration as shown in FIG. 2 an extended configuration as shown in FIG. 6. Each rectilinear end frame 112 is substantially vertical and includes two laterally separated uprights 114 forming the corners of the playpen 100. The uprights 114 are laterally separated one from the other and are connected by a horizontal bottom frame member 116 and a horizontal top frame member 118 so as to form opposite sides of the frame assembly. The horizontal top frame member 118 includes a handle 120 integrally formed therein to aid in carrying the playpen 100 by a user. The two laterally separated vertical rectilinear end frames 112 are maintained in an upright selectively expandable relationship by the scissors mechanism 122. Each end of the scissors mechanism 122 is connected to a respective one of the rectilinear frames 112 at a scissors attachment lug 126 (FIG. 6) formed as part of the bottom frame member 116.

Figure 3:
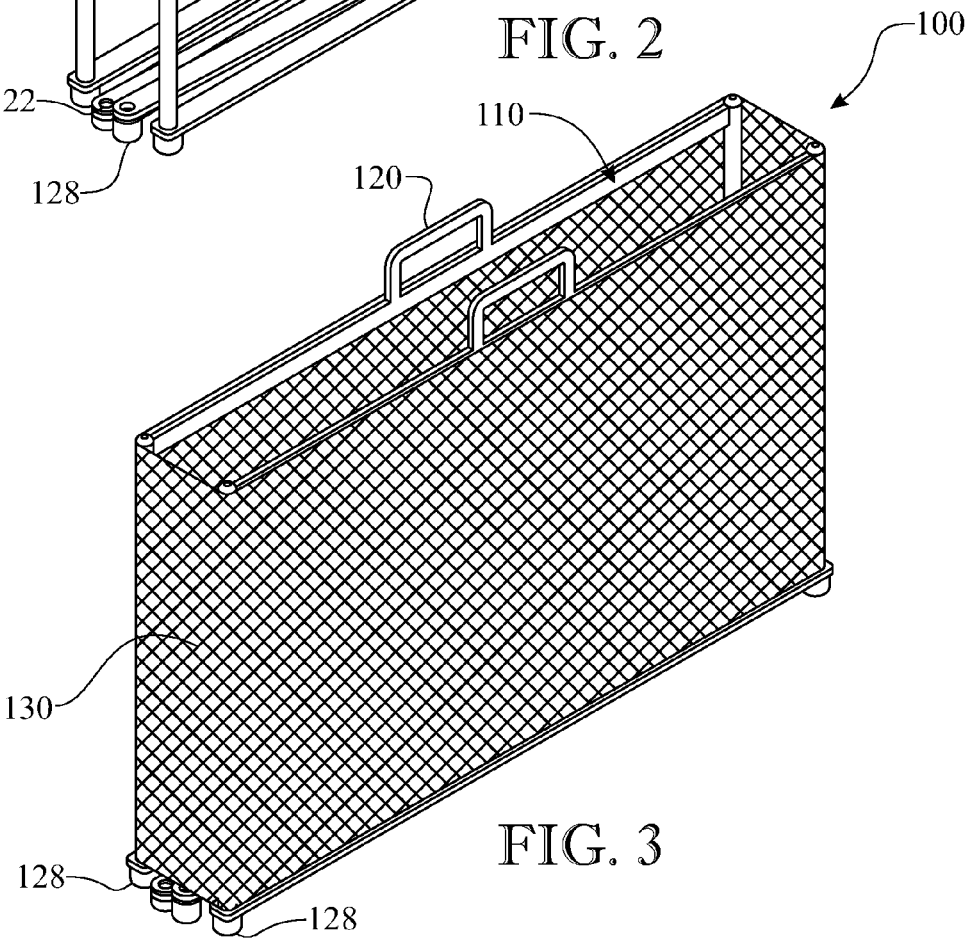
FIG. 3 presents an isometric view of the collapsed playpen frame of the playpen, originally introduced in FIG. 1, including a plastic mesh surrounding the playpen frame.

Referring now to FIG. 3, the collapsed frame assembly 110 is surrounded by a flexible mesh 130. The flexible mesh 130 can be of many known configurations that include the characteristics of being flexible, having a plurality of holes therethrough to permit air flow and to allow visibility therethrough. The flexible mesh 130 can be expandable to conform to the collapsed and expanded configurations of the frame assembly 110.

Figure 4:
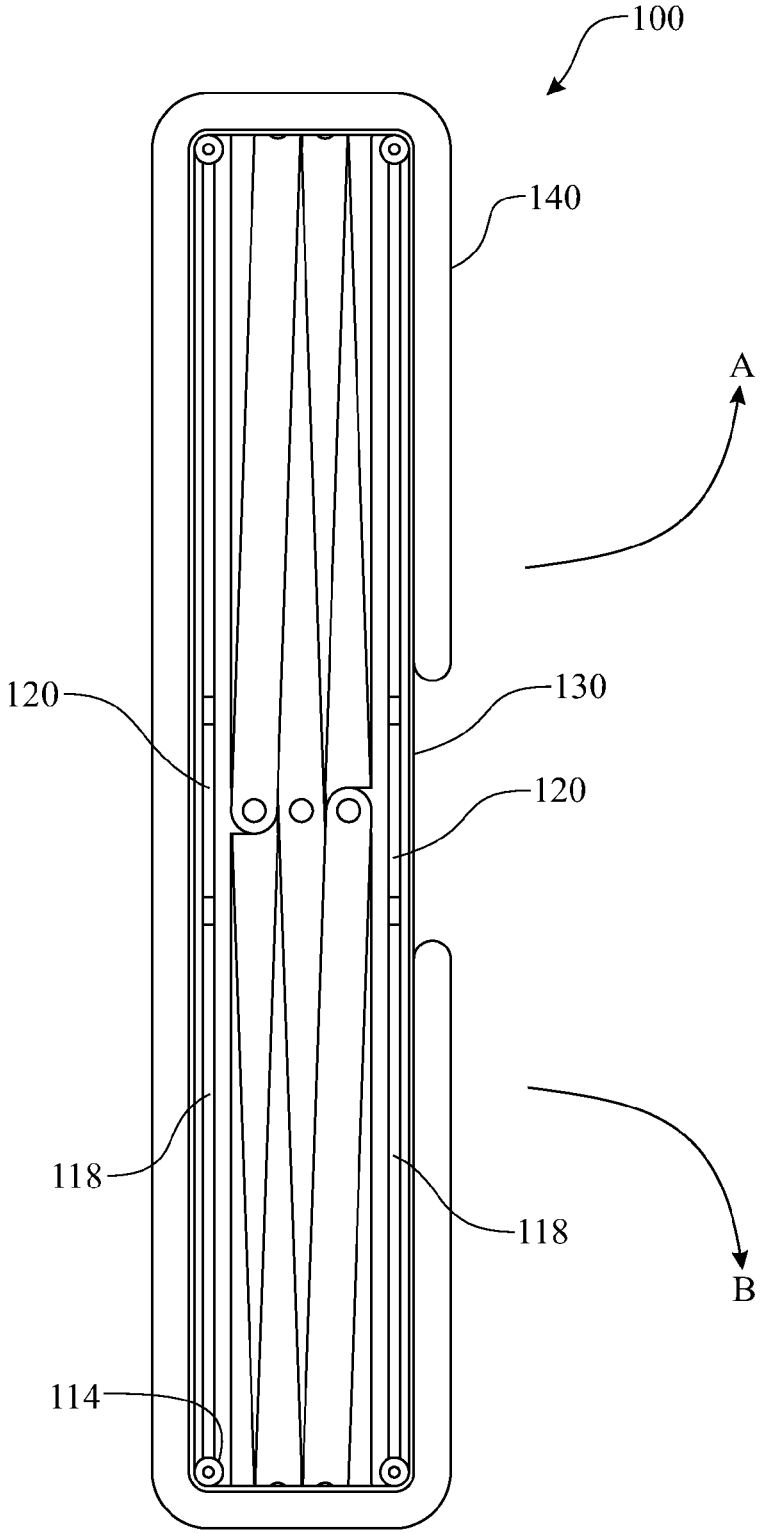
FIG. 4 presents a top plan view of the playpen, originally introduced in FIG. 1, in a collapsed configuration and including a floor pad stowed about an exterior of the collapsed playpen.
Figure 5:
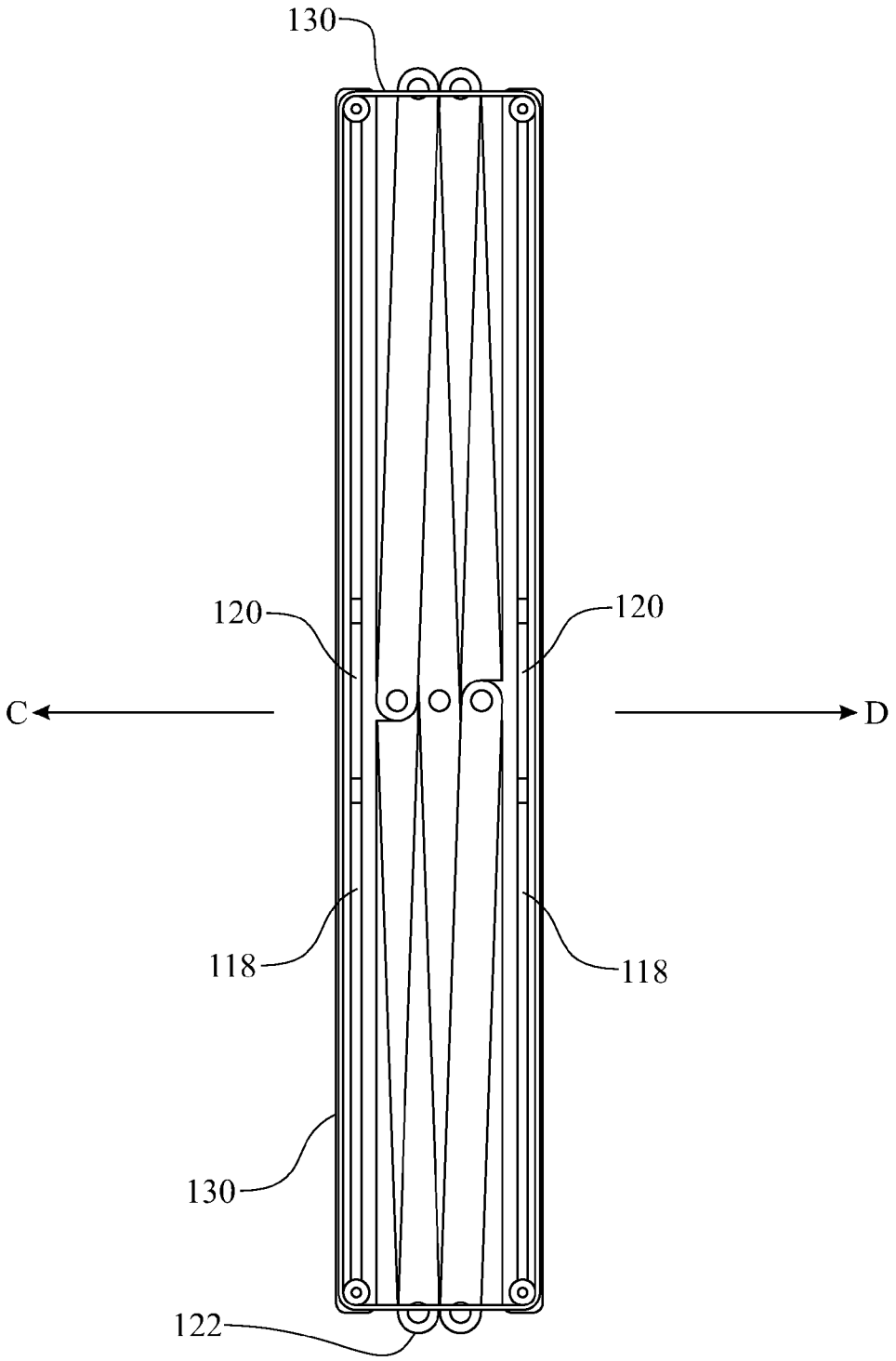
FIG. 5 presents a top plan view of the playpen, originally introduced in FIG. 1, in a collapsed configuration with the floor pad removed immediately prior to expanding the playpen.

As shown in FIG. 4, the playpen 100 is shown in its collapsed configuration for storage or for convenient transport. The bottom pad 140 is folded about an exterior of the collapsed playpen 100 to form a compact configuration. When a user desires to use the playpen 100, the ends of the bottom pad 140 are peeled away from the collapsed playpen 100 in opposite directions as designated by the arrows "A" and "B". Once the bottom pad 140 has been removed from the collapsed playpen 100, the playpen 100 can be expanded by pulling the vertical rectilinear frames 112, one away from the other, as illustrated by arrows "C" and "D" (FIG. 5).

Figure 7:
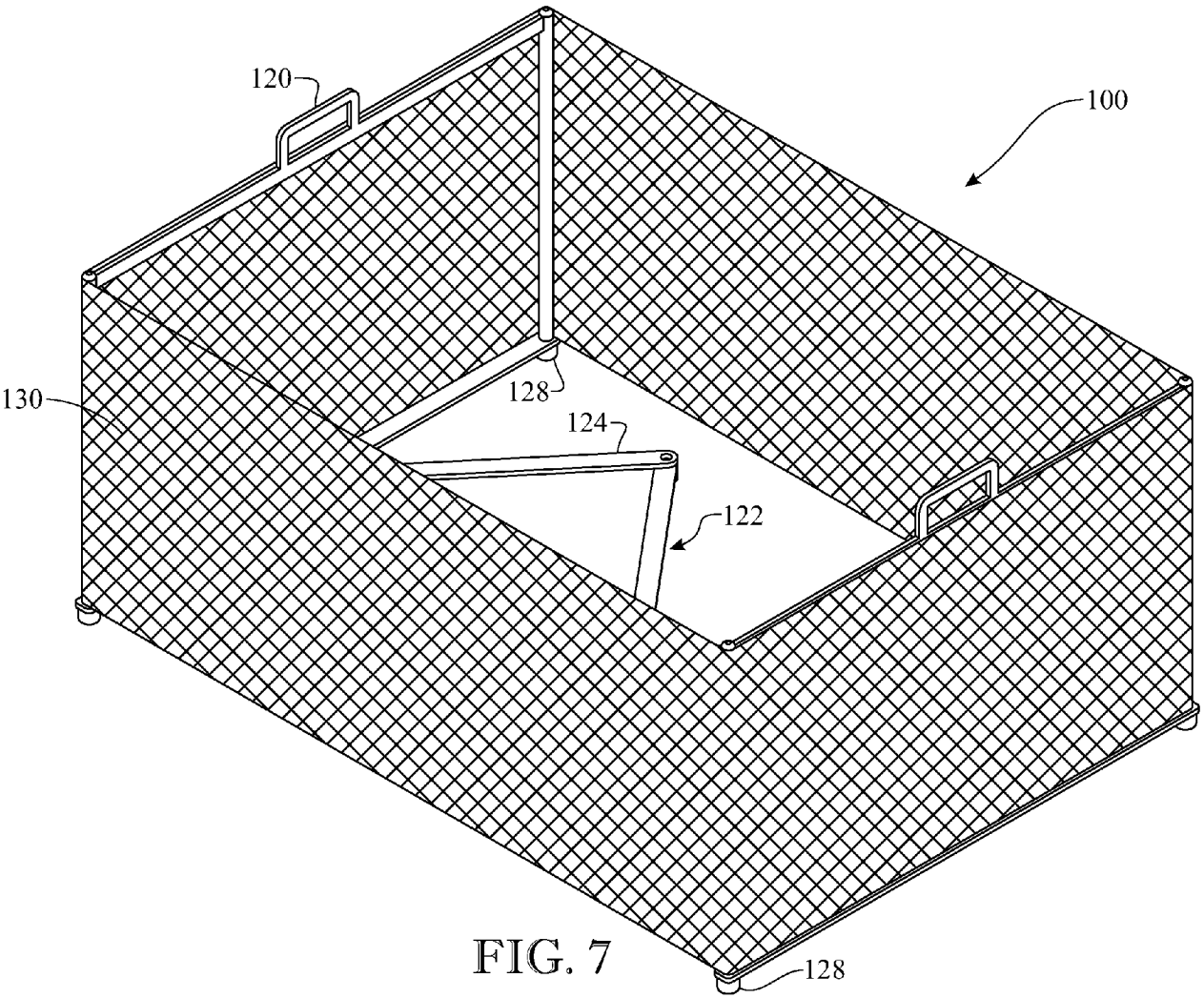
FIG. 7 presents a top isometric view of the playpen, originally introduced in FIG. 1, in its expanded configuration with the plastic mesh surrounding the playpen.

As best shown in FIG. 6, the expanded frame assembly 110 includes the two vertical rectilinear frames 112 substantially parallel one to the other and separated one from the other by the scissors mechanism 122. The scissors mechanism 122 is of a standard known configuration and is comprised of a plurality of scissors elements 124 hinged together at hinge points 123 in a manner to permit the rectilinear frames 112 to laterally separate and collapse one with respect to the other. The scissors mechanism 122 is affixed to vertical rectilinear frames 112 at the scissors attachment lugs 126 formed substantially at a midpoint of the bottom frame member 116. Each hinge point 123 as well as the vertical uprights 114 are supported by support feet 128 to prevent sliding of the playpen 100 or the scratching of a floor surface on which the playpen 100 is resting. Further, as shown in FIG. 7, the playpen 100 includes therearound the flexible mesh 130 to act as a barrier to keep a child inside the playpen 100, while allowing airflow therethrough and maintaining visibility to the interior of the playpen 100.

Figure 8:
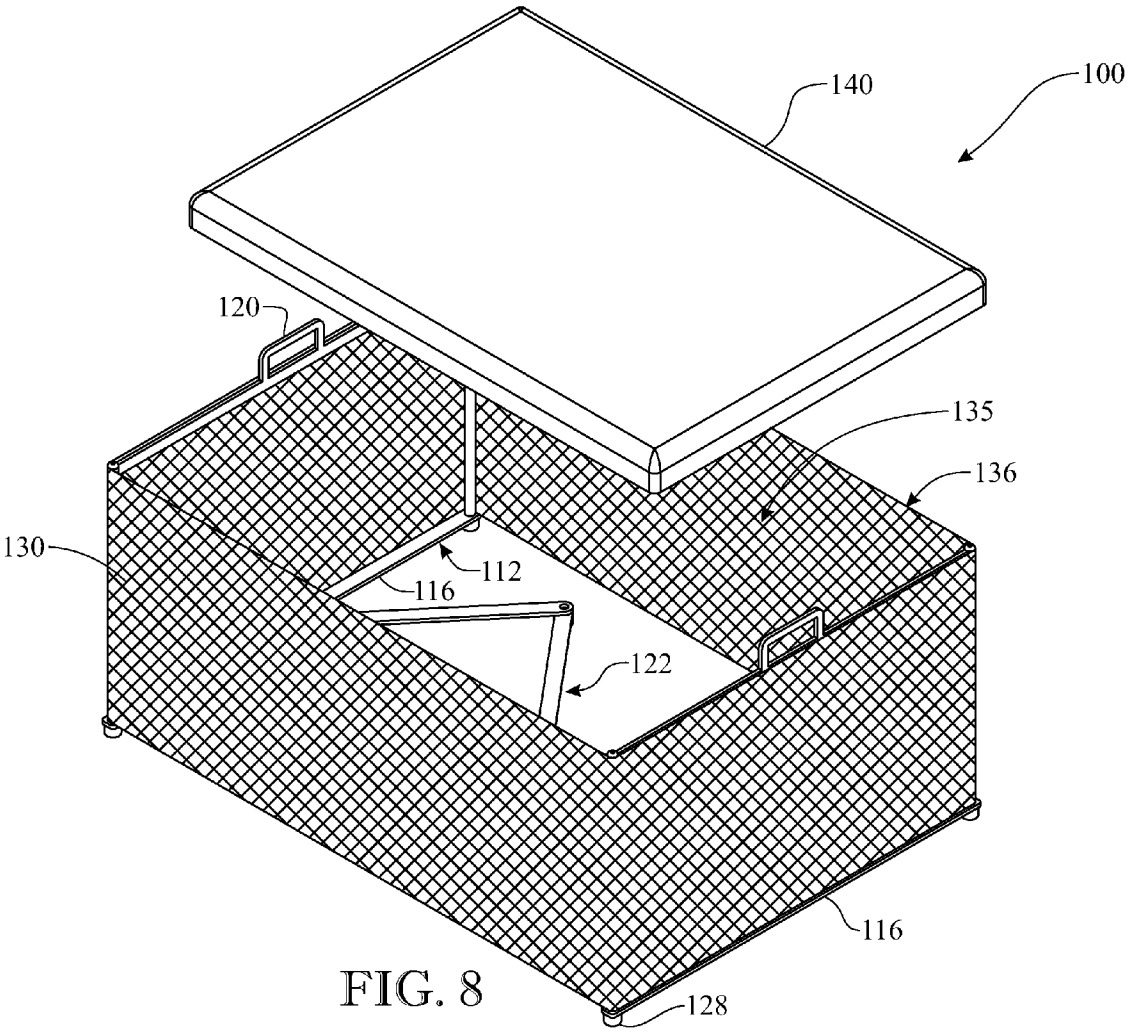
FIG. 8 presents a partially exploded top isometric view of the playpen, originally introduced in FIG. 1, and the floor pad.

As illustrated in FIG. 8, once the flexible mesh 130 surrounding playpen frame assembly 110 has been expanded, the unfolded support pad 140 is inserted into the interior 135 of the playpen 100 through a rectilinear open top 136 thereof as defined by the surrounding flexible mesh 130. When fully inserted, the support pad 140 rests in contact with and is supported on the scissors mechanism 122 and the bottom frame members 116 of rectilinear end frames 112 (FIG. 1) so as to provide a closed bottom 137 (FIG. 9) of the interior 135 of the playpen 100 surrounded by the flexible mesh 130. The flexible mesh or covering 130 extending about a periphery, along and between and in contact with the opposite sides, of the frame assembly 110 forms a plurality of side walls in a rectilinear configuration defining the interior 135 of the playpen with the open top and bottom 136, 137 thereof.

Figure 9:
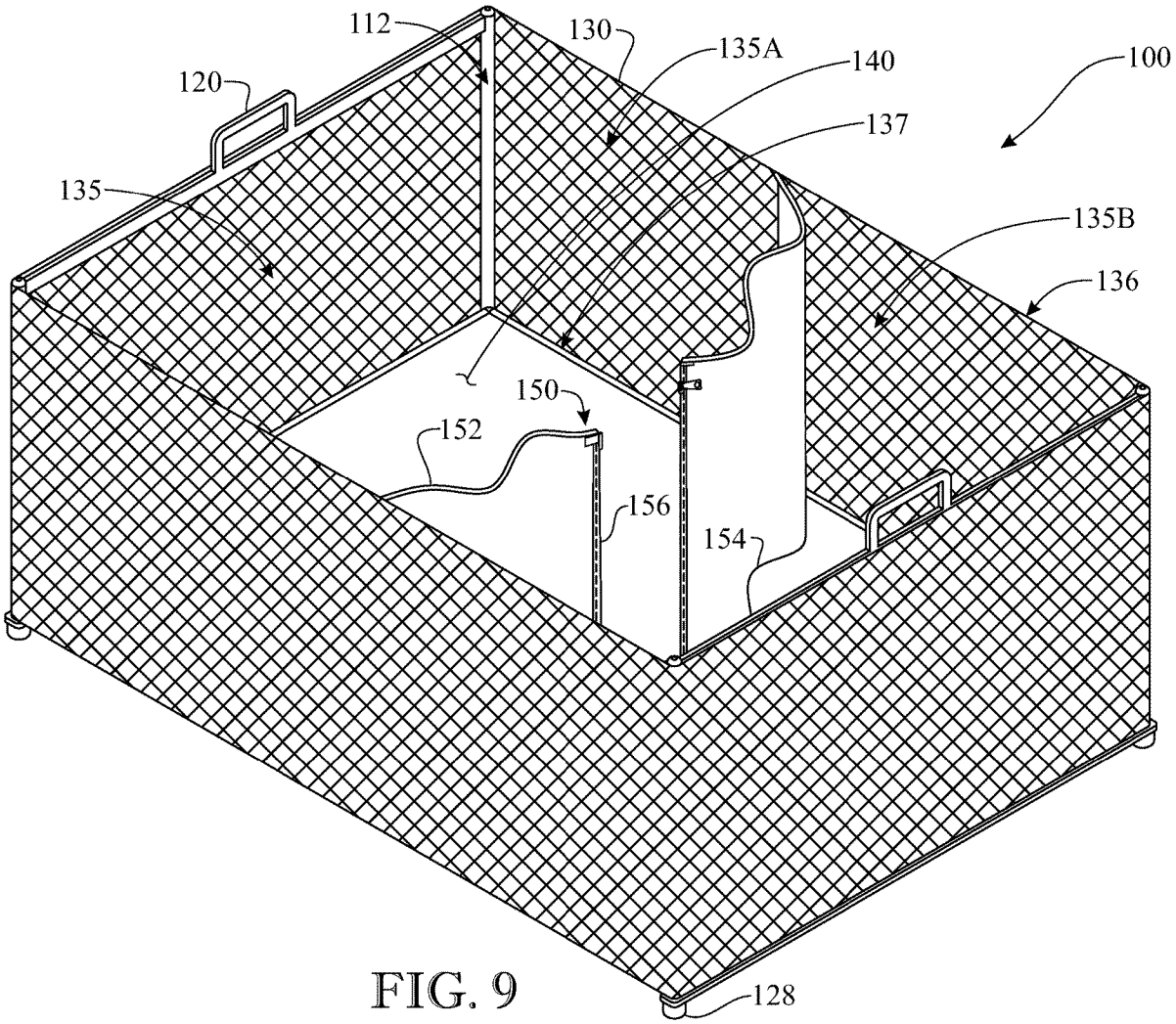
FIG. 9 presents a top isometric view of the playpen, originally introduced in FIG. 1, including a central divider.

Referring now to FIG. 9, the playpen 100 can also include a central divider 150 disposed in the interior 135 of the playpen 100, extending from one side wall of the flexible mesh 130 on one side of the playpen 100 to an opposing side wall of the flexible mesh 130 on an opposite side of playpen 100. The central divider 150 can also be formed of a first panel 152 and a second panel 154, each having one edge thereof affixed to a respective one of the opposing side walls of the flexible mesh 130 on the respective opposite sides of the playpen 100 and sized to meet in the middle of the playpen 100. The first and second panels 152, 154 can each have a portion of a zipper 156 affixed thereto, thereby permitting the selective separation and closure of the first panel 152 with respect to the second panel 154. When the first and second panels 152, 154 are zipped together, the central divider 150 extends across the playpen interior 135 and in a vertical orientation within the playpen interior 135 substantially from proximate to the open top 136 to proximate to the closed bottom 137 thereof. In such disposition and orientation the central divider 150 divides the interior 135 of the playpen 100 into two interior portions 135A, 135B located adjacent to one another but at opposite sides of the central divider 150, each interior portion having a corresponding portion of the open top 136 defined by the flexible mesh 130 and a corresponding portion of the closed bottom 137 defined by the support pad 140 resting and supported on the scissors mechanism 122.

Figure 11:
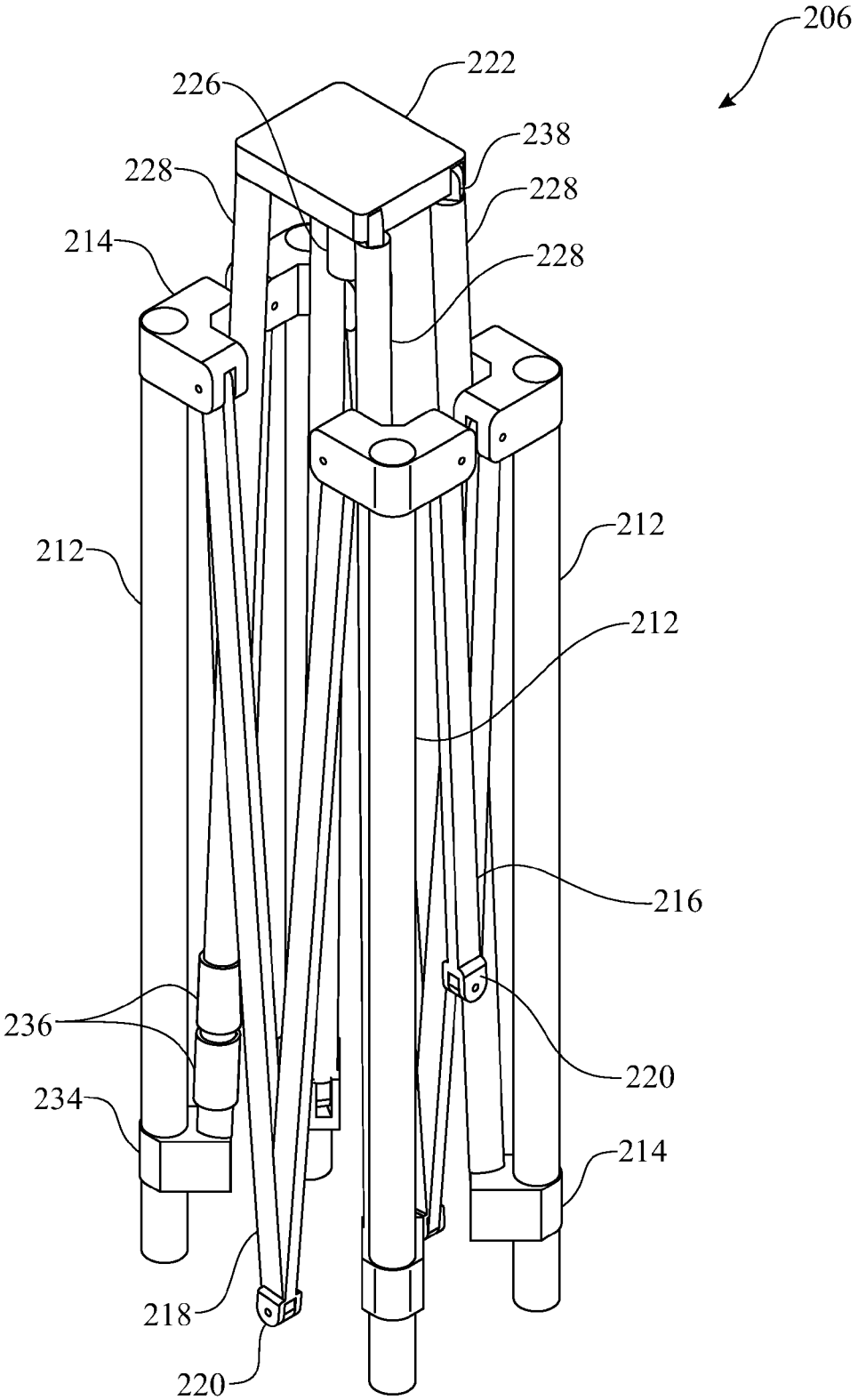
FIG. 11 presents a top isometric view of a folded primary frame of the playpen frame, originally introduced in FIG. 10.
Figure 12:
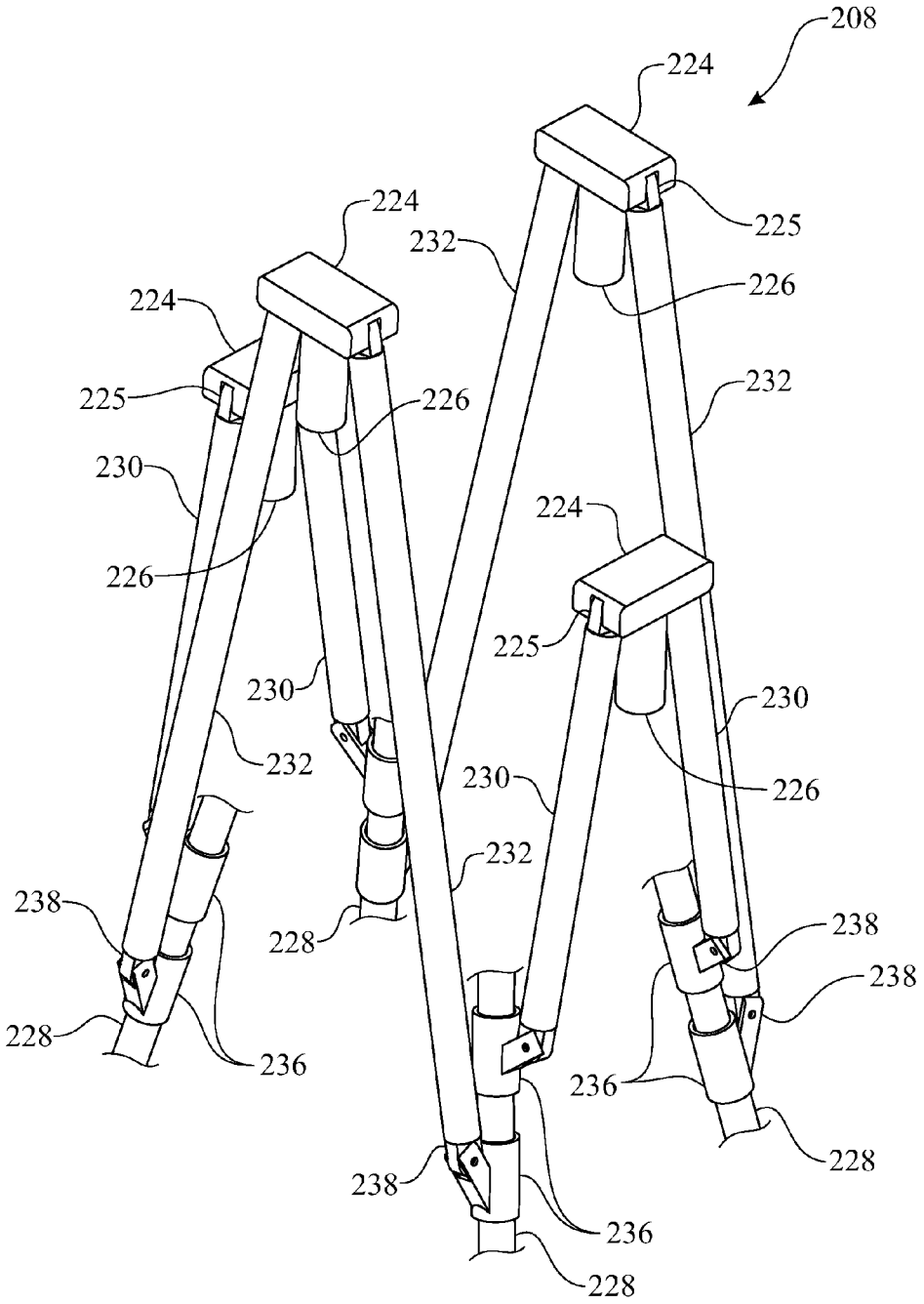
FIG. 12 presents a top isometric view of a folded secondary floor support frame of the playpen frame, originally introduced in FIG. 10.

An alternate embodiment playpen 200 (FIG. 14) includes a supporting frame assembly 204 (FIG. 10) comprised of a primary frame 206 (FIG. 11) and a cooperating secondary floor support frame 208 (FIG. 12). The illustrations of the primary frame 206 in FIG. 11 and the cooperating secondary floor support frame 208 in FIG. 12 have been separated one from the other for the sake of clarity, however, those practiced in the art will readily recognize that the primary frame 206 and the secondary support frame 208 are integrated one with the other for unified operation as discussed in greater detail below.

Figure 10:
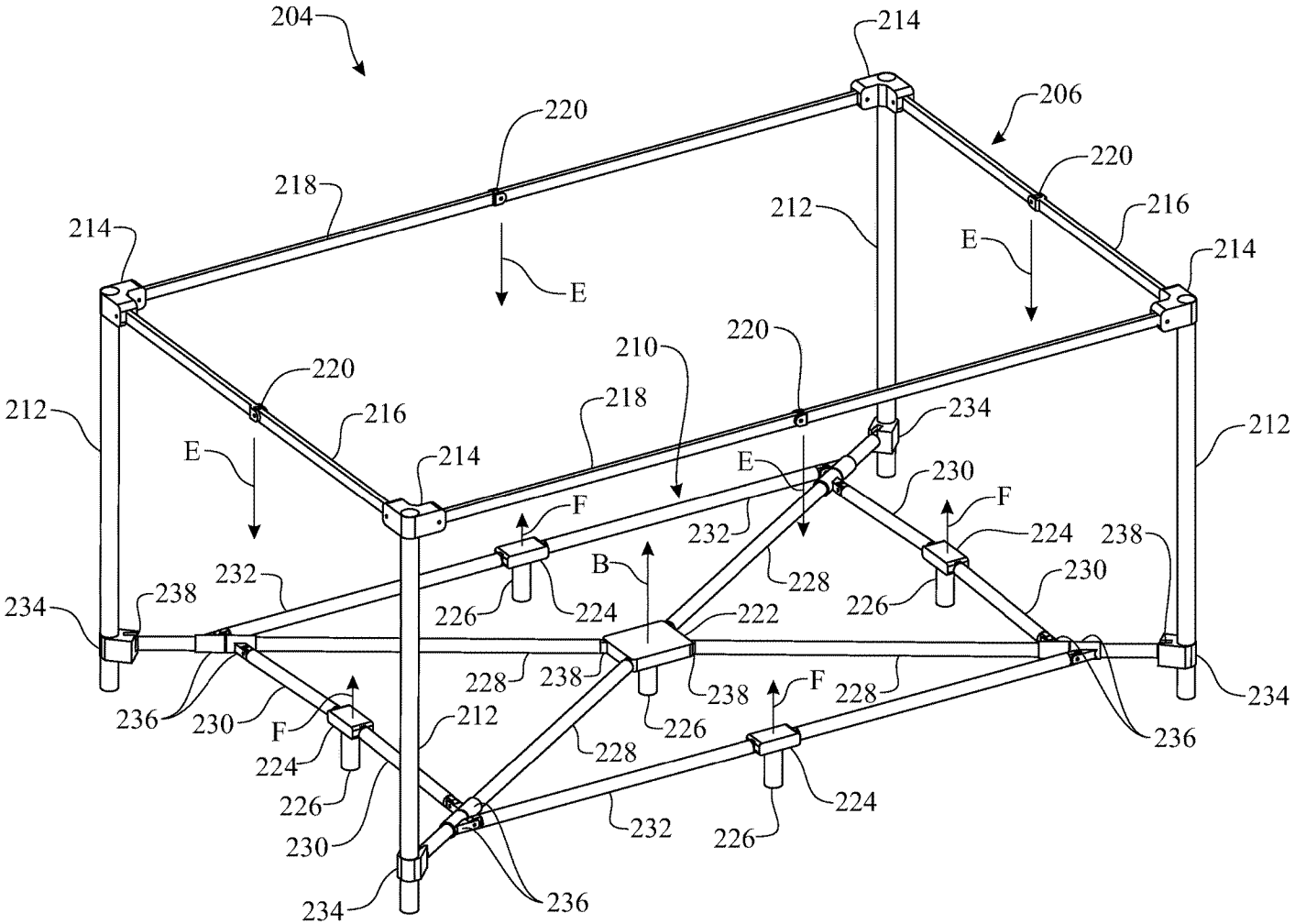
FIG. 10 presents a top isometric view of a playpen frame of an alternate embodiment folding playpen, in an expanded configuration.

Referring to FIGS. 10 and 11, the primary frame 206 has a plurality of parallel corner uprights 212 arranged in a rectilinear pattern. A corner fitting 214 is affixed to the upper end of each corner upright 212. Each corner fitting is formed in an "L" shape and is spatially oriented to correspond to the rectilinear pattern formed by the corner uprights 212. Adjacent ones of the corner fittings 214 are interconnected by a pair of upper end rails 216 and a pair of upper side rails 218. Upper end rails 216 are of an equal first length and upper side rails 218 are of an equal second length wherein the upper side rails 218 are typically of greater length than the upper end rails 216. However, upper end rails 216 can equal the length of the upper side rails 218 to form a substantially square playpen 200. Alternatively, the uprights 212 can form other known geometric configurations and employ the inventive concepts disclosed herein. Upper end rails 216 and upper side rails 218 are hinged at respective midpoints with hinges 220 which permit the rails 216, 218 to be folded when moving the hinges 220 in the direction of arrows "E". When rails 216, 218 are extended, they are selectively locked in the extended position to form the rectilinear shape of the playpen 200.

A corner support 234 is affixed proximate to the bottom of each corner upright 212, and a center support block 222 is positioned at the center of the rectilinear arrangement formed by the corner uprights 212. A cross brace 228 extends from the center support block 222 to each of the corner supports 234. The cross braces 228 are affixed to the center support block 222 and the corner supports 234 with hinges 238 thereby allowing cross braces 228 to pivot with respect to the center support block 222 and the corner supports 234. When extended, the cross braces 228 in diagonal fashion substantially form an "X" pattern to provide a co-planar support at the lower end of the frame assembly 204. The center support block includes a leg 226 extending downward to bear upon the surface on which the playpen 200 is placed. The length of leg 226 supports center support block 222 in a substantially co-planar manner with the corner supports 234.

Referring now to FIGS. 10 and 12, the frame assembly 204 also includes the secondary floor support frame 208. The secondary floor support frame 208 includes a pair of intermediate end braces 230 centrally joined by a secondary support block 224 and extending between adjacent ones of cross braces 228 at opposing ends of the playpen 200. The intermediate end braces 230 are pivotally joined to the secondary support blocks 224 and also pivotally joined to brace fittings 236. The brace fittings 236 are slidably received on the respective cross braces 228 between which the intermediate end braces 230 extend. In like manner, the secondary floor support frame 208 also includes a pair of intermediate side braces 232 centrally joined by a secondary support block 224 and extending between adjacent ones of cross braces 228 at opposing sides of the playpen 200. The intermediate side braces 232 are pivotally joined to the secondary support blocks 224 and also pivotally joined to brace fittings 236. The brace fittings 236 are slidably received on the respective cross braces 228 between which the intermediate end braces 230 extend. Each secondary support block 224 includes a leg 226 extending downward to bear upon the surface on which the playpen 200 is placed. The length of leg 226 supports its respective secondary support block 224 in a substantially co-planar manner with the corner supports 234. The braces, 228, 230, 232 and the support blocks 222, 224 can be hinged together by hinges 125 and, in combination, form a substantially co-planar grid 210 which supports a bottom pad, such as the bottom pad 140 described above on which a baby can rest while in the playpen 200.

Alternatively, a single intermediate brace 230, 232 can extend between adjacent ones of the cross braces 228 wherein the intermediate brace 230, 232 is centrally hinged permitting the intermediate brace 230, 232 to be folded against itself in a fashion similar to the folding upper rails 216, 218.

Figure 13:
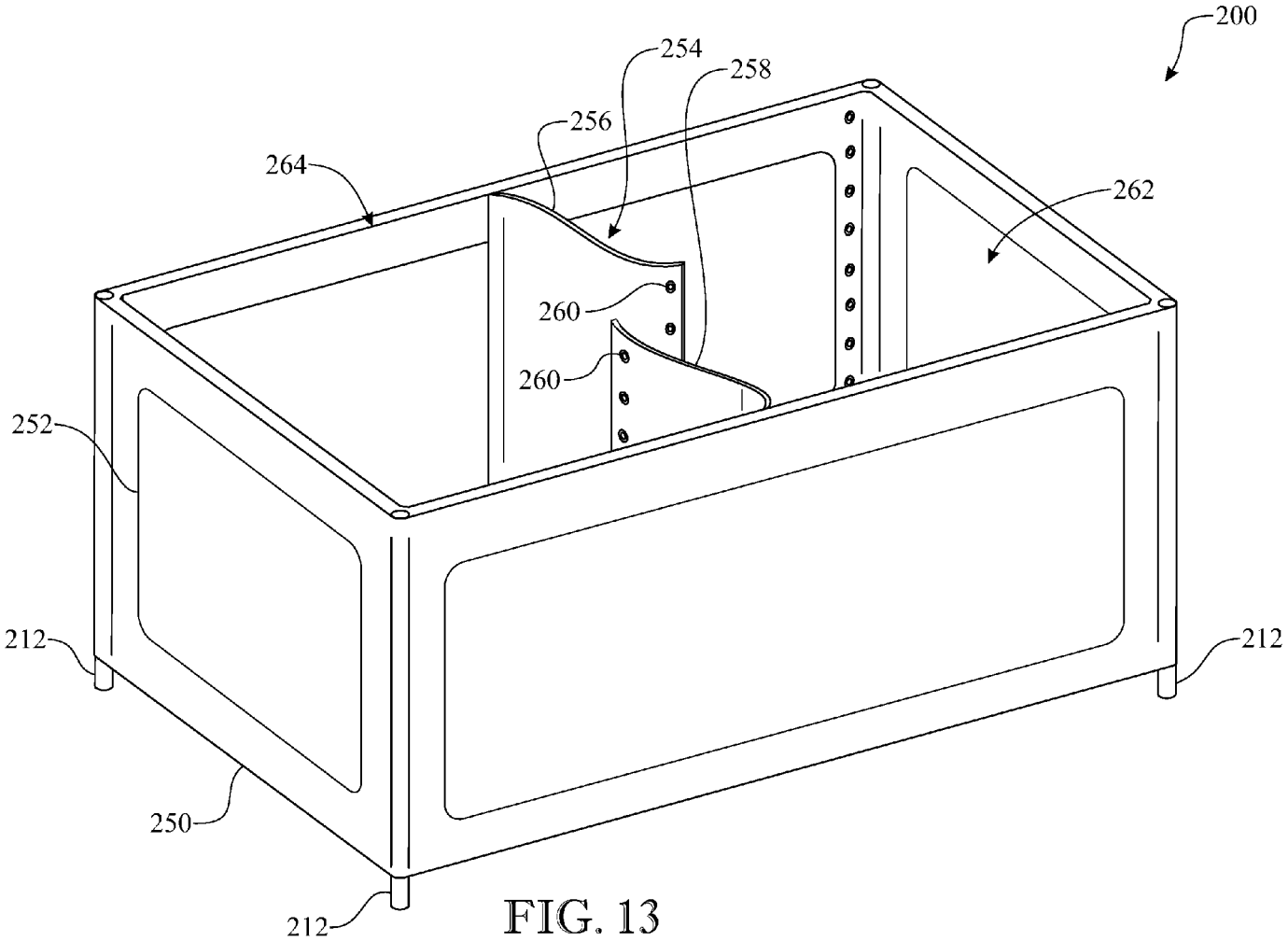
FIG. 13 presents a top isometric view of an expanded assembled playpen, utilizing the playpen frame originally introduce in FIG. 10, with a playpen frame covering and a separated center divider.
Figure 14:
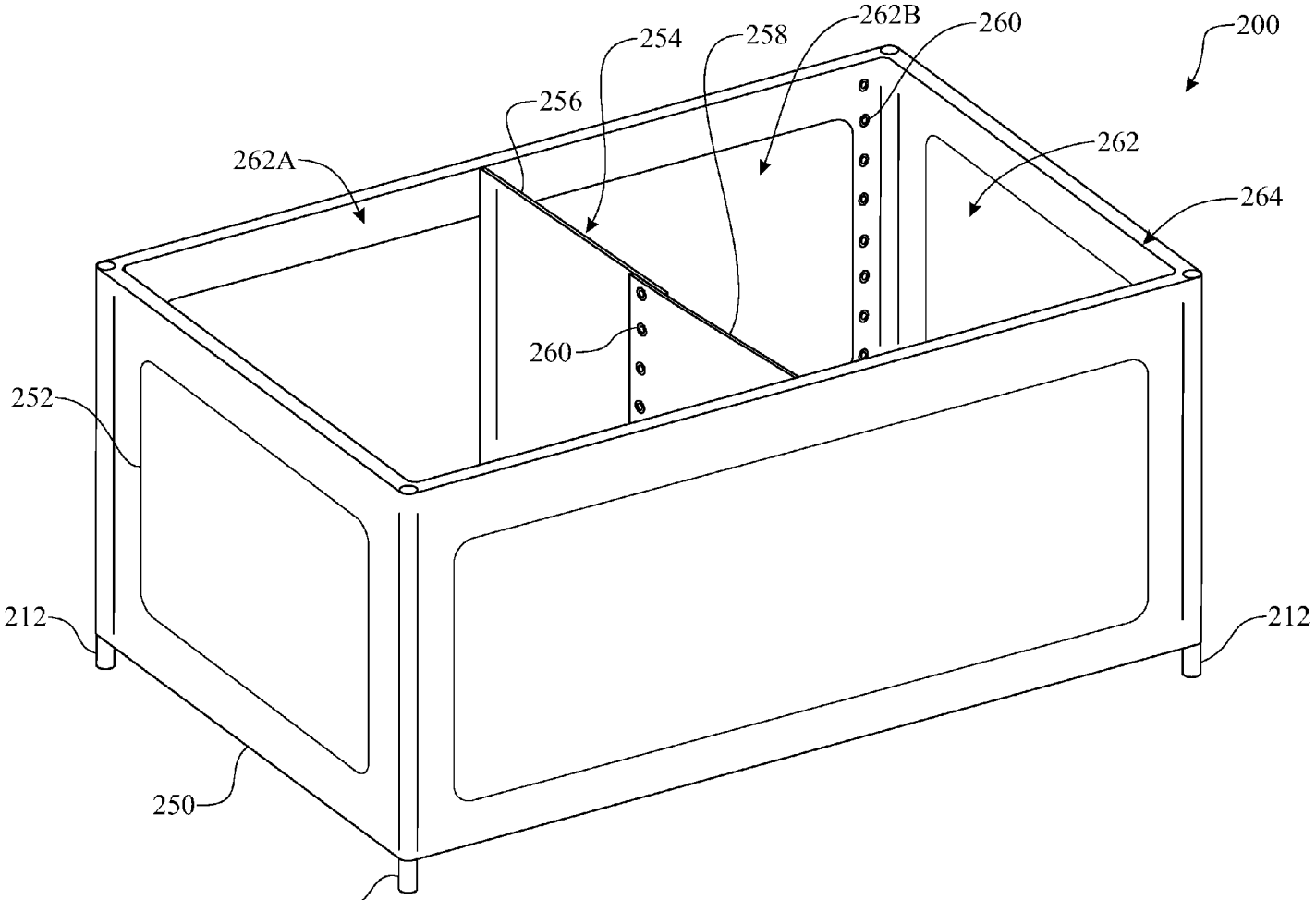
FIG. 14 presents a top isometric view of the expanded assembled playpen of FIG. 13 with a fastened center divider.
Figure 15:
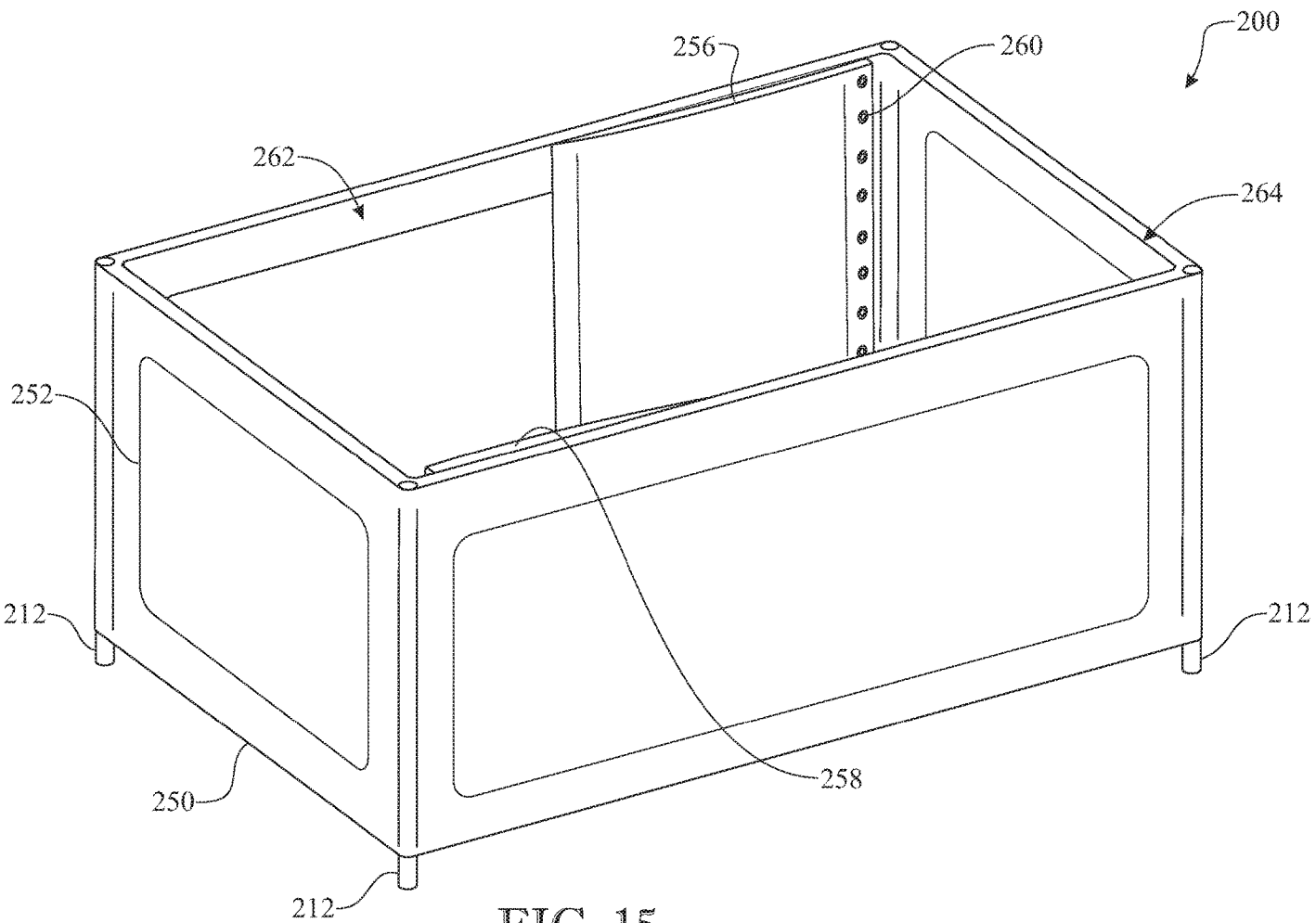
FIG. 15 presents a top isometric view of the expanded assembled playpen of FIG. 13 with the center divider unfastened and stowed against the playpen sides.

As illustrated in FIGS. 13 through 15, the ends and sides of the frame assembly 204 of the playpen 200 are surrounded by a flexible covering 250 which substantially extends between adjacent ones of corner uprights 212 and can include inserts 252 of a mesh to permit the circulation of air for the comfort of a baby placed in an interior 262 of the playpen 200 defined by the flexible covering 250. The playpen 200 also includes a removable bottom pad similar to bottom pad 140 described above on which a child may sit, rest, or play. The bottom pad can be segmented to fold into a desired shape consistent with the collapsed configuration of the playpen 200 as described further below.

The playpen 200 also includes a central divider 254 disposed in the interior 262 of the playpen 200, extending from one side wall of the flexible covering 250 on one side of playpen 200 to an opposing side wall of the flexible covering 250 on an opposite side of playpen 200. The central divider 254 can also be formed of a first panel 256 and a second panel 258, each having one edge thereof affixed to a corresponding one of the opposing side walls of the flexible covering 250 on opposite sides of the playpen 200 and sized to joinably meet in the middle of the playpen 200. The first and second panels 252, 254 can each have a portion of fasteners 260 affixed thereto, thereby permitting the selective separation and closure of the first panel 256 with respect to the second panel 258. When the first and second panels 256, 258 are fastened to one another as seen in FIG. 14, the central divider 254 extends across the playpen interior 262 and in a vertical orientation within the playpen interior 262 substantially from proximate to an open top 264 to proximate to a closed bottom (not shown) of the playpen interior 262. In such disposition and orientation the central divider 254 divides the interior 262 of the playpen 200 into two interior portions 262A, 262B located adjacent to one another but at opposite sides of the central divider 254, each interior portion having a corresponding portion of the open top 264 defined by the flexible covering 250 and a corresponding portion of the closed bottom (not shown) defined by the bottom pad, resting and supported on the co-planar grid 210 (FIG. 10). When the playpen 200 is to be used undivided by the central divider 254, each of the first and second panels 256, 258 can be stowed against the sides of the playpen 200 by engagement with matching portions of fasteners 260 on the sides of the playpen 200, as best illustrated in FIG. 15.

Figure 16:
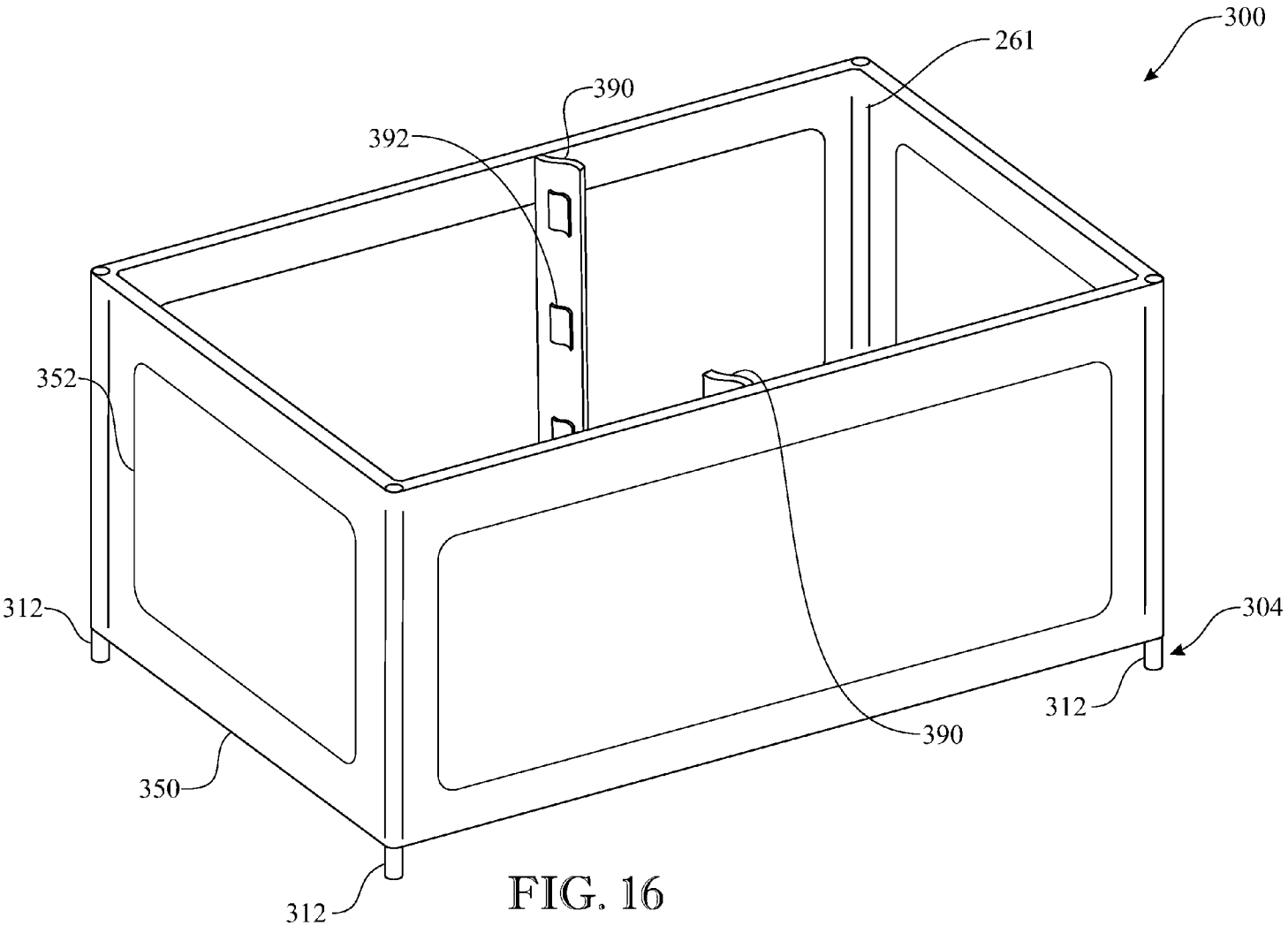
FIG. 16 presents a top isometric view of an alternate embodiment playpen having a removable center divider with the divider removed.
Figure 17:
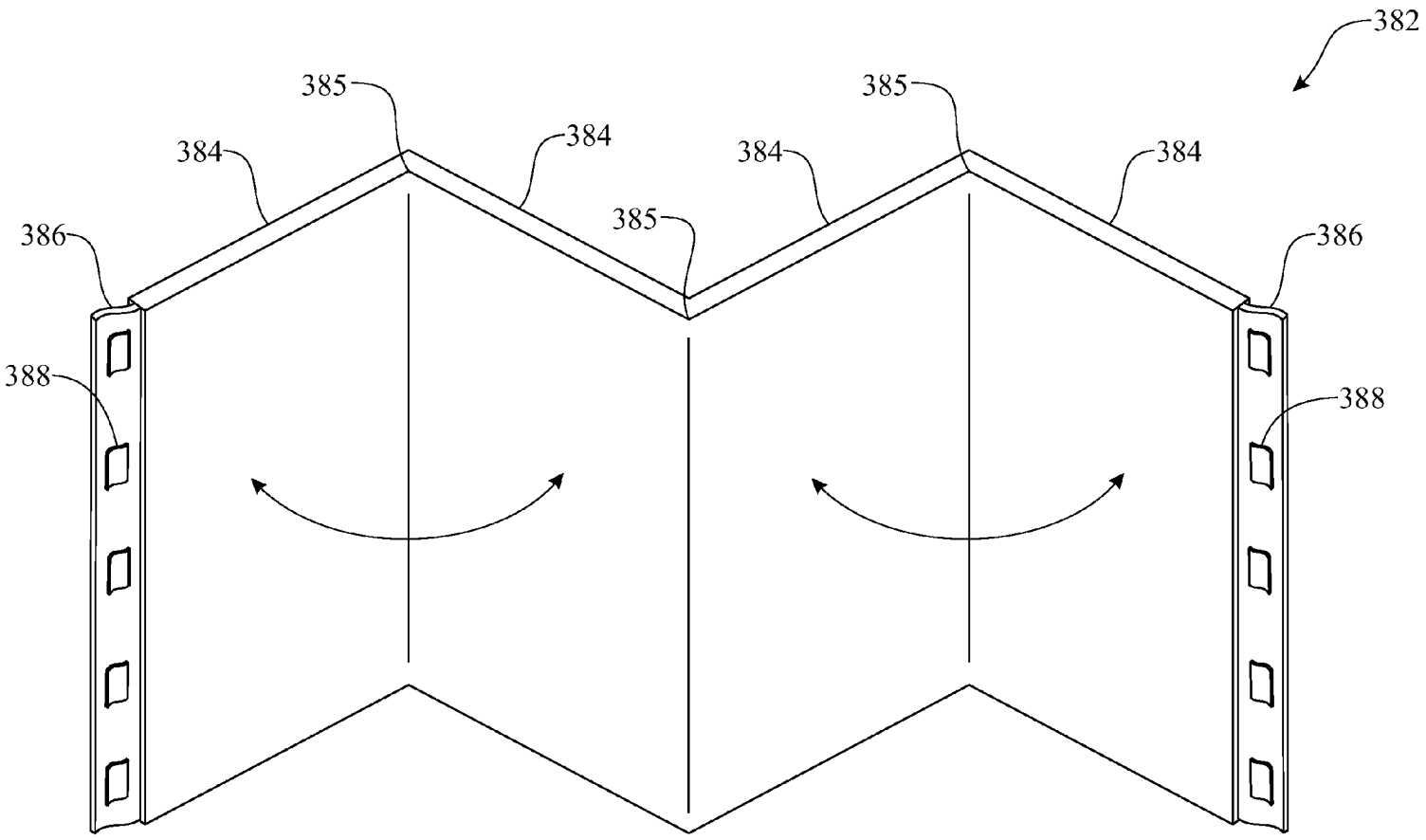
FIG. 17 presents a top isometric view of the removed center divider for the playpen of FIG. 16.
Figure 18:
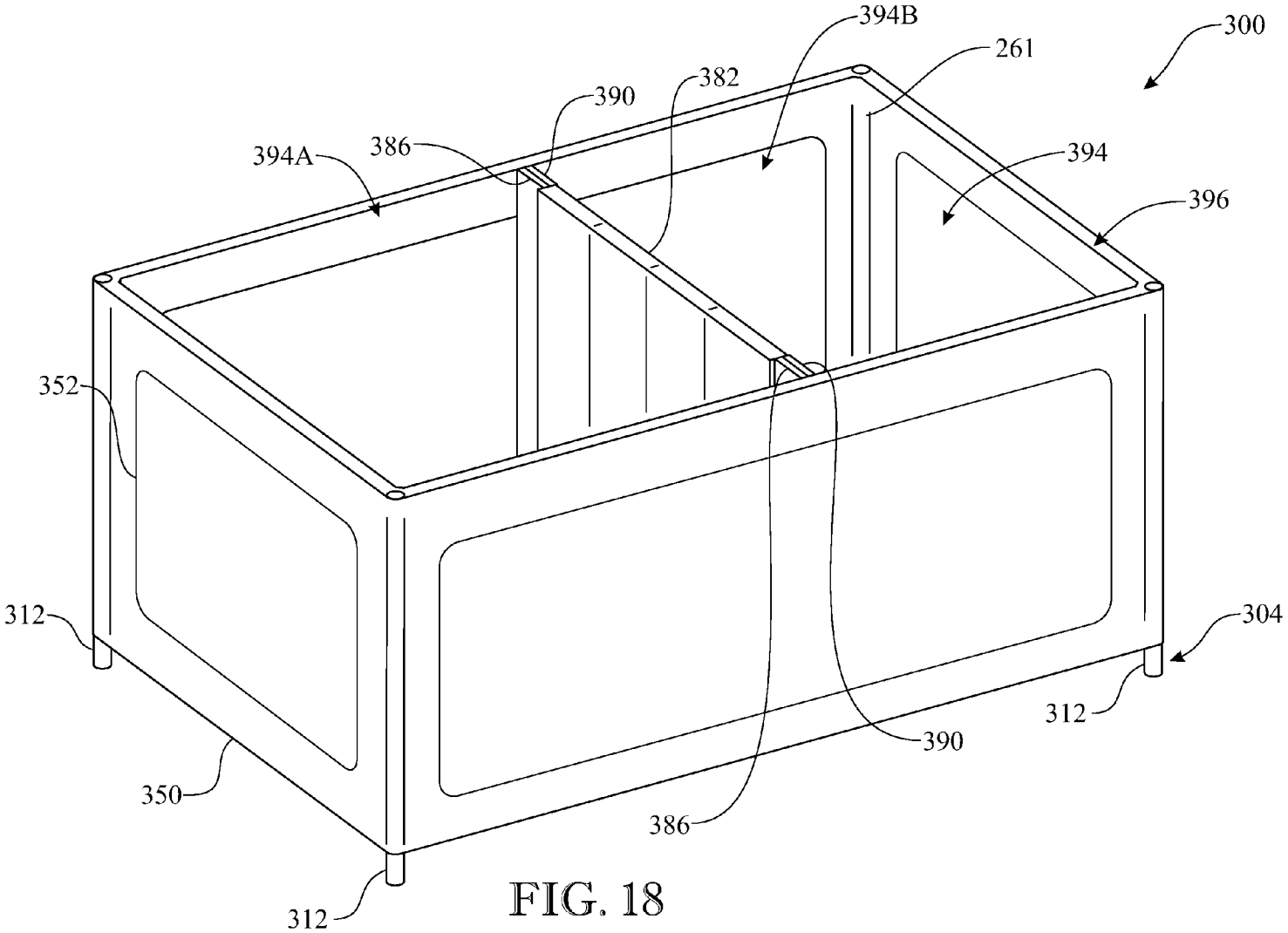
FIG. 18 presents a top isometric view of the playpen, originally introduced in FIG. 16, with the folding divider installed.

An alternate embodiment playpen 300 is illustrated in FIGS. 16-18 wherein the playpen 300 includes a frame assembly 304 identical to the frame assembly 204 which is surrounded by a flexible covering 350 which extends between adjacent ones of corner uprights 312 and can also include inserts 352 of a mesh to permit the circulation of air for the comfort of a baby placed in the interior thereof. Opposing tabs 390 can be permanently affixed to midpoints of opposing sides of the playpen 300. The tabs 390 extend substantially from the top to the bottom of the playpen 300 and include thereon a plurality of hook and loop fastener segments 392, or alternatively a single strip of hook and loop fastener extending the length of the tabs 390.

A central divider 382 (FIG. 17) includes a plurality of individual panels 384 interconnected by integral hinges 385, or folds, and arranged such that the panels 384 can be folded one against an adjacent panel 384 for convenient storage and transport. A tab 386 is attached at each end of the central divider 382 extending from a top to a bottom thereof. The tabs 386 include thereon a plurality of hook and loop fastener segments 388, or, alternatively, a single strip of hook and loop fastener extending the length of the tabs 386. The hook and loop fastener segments 388, 392 are arranged such that segments 388, 392 are interlocking segments one with the other in a manner well known in the art. Those practiced in the art will recognize that the fasteners 388, 392 utilized to attach the central divider 382 to the tabs 390 can be hook and loop, snap, zipper, button or other known fasteners.

The central divider 382 can be installed by unfolding the central divider 382 and placing the central divider 382 so that its tabs 386 are proximate to corresponding ones of tabs 390 on opposing side walls of the flexible covering 350 of the playpen 300, as seen in FIG. 18. Like positioned ones of the hook and loop segments 388, 392, as seen in FIGS. 17 and 16, are engaged one with the other thereby dividing the playpen interior 394 into two distinct areas or interior portions 394A, 394B, as seen in FIG. 18, where different babies can be placed without interacting one with the other. When installed in the playpen interior 394 as seen in FIG. 18, the central divider 382 extends across the playpen interior 394 and in a vertical orientation substantially from proximate to an open top 396 to proximate to a closed bottom (not shown) of the interior 394 of the playpen 300. In such disposition and orientation the central divider 382 divides the playpen interior 394 into the two interior portions 394A, 394B located adjacent to one another but at opposite sides of the central divider 382, each interior portion having a corresponding portion of the open top 396 defined by the flexible covering 350 and a corresponding portion of the closed bottom defined by the support pad, similar to the pad 140 described above, resting and supported on the co-planar grid (not shown) of the playpen 300. Once the playpen 300 is desired to be used with only a single large interior area, the hook and loop segments 388, 392 are disengaged one from the other. The central divider 382 is then removed from the playpen 300 and is folded at hinges 385 for storage or transport.

Figure 19:
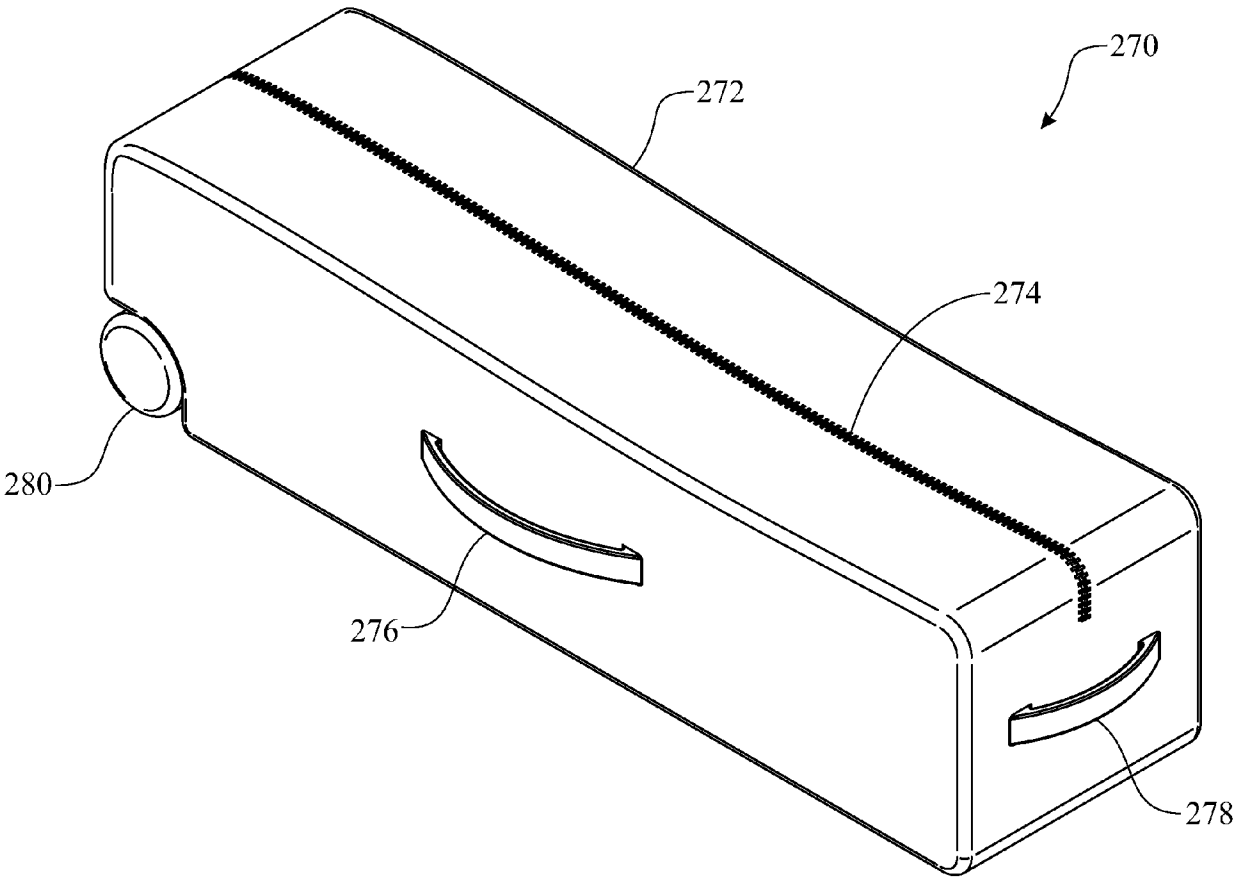
FIG. 19 presents a top isometric view of a carrying case for embodiments of the folding playpen.

Referring to FIG. 19, a carrying case 270 is illustrated which conforms to the size and shape and is receptive of a folded playpen 200 for storage or transportation of the playpen 200. The carrying case 270 comprises a durable case 272 and has an interior selectively accessible through zipper 274. A side handle 276 facilitates a user to pick up and carry the stored playpen 200. An alternate end handle 278 in combination with wheels 280 permits a user to raise the carrying case 270 at one end and be able to roll the carrying case 270 and stored playpen 200 on the wheels 280 in a known fashion.

In use, and referring again to FIGS. 10 through 19, the playpen 200 can be transitioned from a stored configuration by removing the folded playpen 200 from the carrying case 279 through the zipper 274 to an extended configuration as illustrated by the configuration of the frame assembly 204 in FIG. 10 and covered configuration of FIG. 13. The zipper 274 is opened and the folded frame 204 is removed from the carrying case 270 and placed in an upright orientation as illustrated in FIGS. 11 and 12. The corner uprights 212 are moved away one from the other. This expansion results in the lowering of the center support block 222 and secondary support blocks 224 toward the surface on which the playpen 200 is to be supported. As the frame 204 unfolds, the various brace fittings 236 connecting the intermediate end and side braces 230, 232 to the cross braces 228 are free to translate along the length of the cross braces 228 and, as a result of the angular orientation of the cross braces 228 one with the others, will automatically be positioned in the deployed configuration when the frame assembly 204 is fully expanded. As the frame assembly 204 expands, the corner uprights 212 move into their designed rectilinear configuration and the cross braces 228, center support block 222, intermediate braces 230, 232, and secondary support blocks 224 expand into a substantially co-planar configuration. The support blocks 222, 224 are supported on the floor surface by the legs 226 extending downwardly therefrom. The flexible covering 250 is then fitted over the frame assembly 250 and the bottom pad, such as one similar to bottom pad 140, is placed in the fitted flexible covering 250 to rest upon the braces 228, 230, 222 and support blocks 222, 224. The playpen 200 is then ready for use either as a single enclosure with panels 256, 258 separated one from the other, or as a dual enclosure where panels 256, 258 are connected with fasteners 260 to form a central divider 254.

After completion of use, the playpen 200 can be collapsed and stored in reverse fashion as described above. The bottom pad is removed and folded for storage, and the flexible covering 250 is removed from the frame assembly 204 and folded for storage. To collapse the frame assembly 204 to its storage configuration, the center support block 222 and the secondary support blocks 224 are, in near simultaneous fashion, raised. As the support blocks 222, 224 are raised, the braces 228, 230, 232 are angled from their co-planar relationship and the corner uprights 212 are gradually drawn into the collapsed, folded configuration of FIGS. 11 and 12. The folded frame assembly 204, the folded covering 250, and the folded bottom pad can be placed in the carrying case 270 and the zipper 274 closed to a folded and compact configuration convenient for transporting and storage in the carrying case 270

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A folding playpen comprising:

a frame assembly in an extended configuration comprising a plurality of parallel uprights being spaced apart from one another and arranged in a rectilinear configuration, at least some of said uprights being interconnected to one another so as to form at least a pair of opposite sides of said frame assembly, and a co-planar grid extending between and interconnecting said pair of opposite sides of said frame assembly proximate to bottom portions thereof;

wherein said frame assembly is selectively collapsible from said extended configuration to a storage configuration;

a flexible covering surrounding, along and between and in contact with said opposite sides, said frame assembly so as to form a plurality of side walls of said flexible covering in a rectilinear configuration defining an interior of said playpen having an open bottom and an open top, said flexible covering being selectively removable from said frame assembly;

a pad, separate from said flexible covering, being in contact with and supported upon said co-planar grid proximate to said bottom portions of said frame assembly so as to transform said open bottom of said interior of said playpen to a closed bottom of said interior of said playpen, said pad being selectively removable from said co-planar grid to enable collapsing said frame assembly from said extended configuration to said storage configuration; and a vertically-oriented central divider selectively extendable in a horizontal direction within said interior of said playpen between a pair of opposing ones of said side walls of said flexible covering and extending vertically substantially from a divider upper edge proximate to said open top to a divider lower edge proximate to said closed bottom of said interior of said playpen so as to divide said interior of said playpen into at least a pair of interior portions located adjacent to one another but at opposite sides of said central divider, each of said interior portions having a bottom surface comprised of a corresponding portion of said pad, wherein when fully extended, said central divider has a first side edge attached to a first one of said opposing sides of said flexible covering of said folding playpen, and an opposite second divider side edge attached to a second one of said opposing sides of said flexible covering of said folding playpen.

2. The folding playpen according to claim 1, wherein said frame assembly in said storage configuration together with said flexible covering and said pad being removed from said frame assembly are disposed in a carrying case adapted to be pulled from one end of said carrying case and rolled on wheels at an opposite end of said carrying case being mounted on one of said frame assembly and said carrying case.

3. The folding playpen according to claim 1 wherein said central divider comprises selectively separable panels affixed to said pair of opposing ones of said side walls of said flexible covering, said panels having fastener portions thereon at ends opposite from said pair of opposing ones of said side walls of said flexible covering and fastened one to the other to divide said interior of said playpen into at least said pair of interior portions.

4. The folding playpen according to claim 3 wherein said fastener portions on said panels are selected from a group consisting of hook and loop, snap, zipper, and button fasteners.

5. The folding playpen according to claim 1 wherein each of said pair of opposing ones of said side walls of said flexible covering includes a first tab affixed thereto and extending substantially from proximate to said open top to proximate to said closed bottom of said interior of said playpen, each said first tab including fastener portions affixed thereto; and wherein said central divider is selectively removable from said playpen interior, said central divider having second tabs affixed to and extending from a top to a bottom of opposite ends thereof and including fastener portions on each of said second tabs being engaged with said fastener portions on each of said first tabs affixed to said pair of opposing ones of said side walls of said flexible covering.

6. The folding playpen according to claim 5 wherein said fastener portions on said first and second tabs are selected from a group consisting of hook and loop, snap, zipper, and button fasteners.

7. The folding playpen according to claim 1 wherein said central divider comprises a plurality of individual panels, adjacent ones of said individual panels being interconnected with hinges in a manner to permit said individual panels to be folded one against an adjacent individual panel to facilitate storing said central divider; and wherein ones of said individual panels provided at opposite end portions of said central divider being selectively separably affixable to said pair of opposing ones of said side walls of said flexible covering to facilitate deploying said central divider to divide said interior of said playpen into at least said pair of interior portions.

8. A folding playpen comprising:

a frame assembly in an extended configuration comprising:

a plurality of parallel uprights being spaced apart from one another and arranged in a rectilinear configuration;

a plurality of upper rails pivotally affixed to and extending between top portions of adjacent ones of said uprights so as to form a plurality of opposite sides of said frame assembly; and a co-planar grid extending between and interconnecting said opposite sides of said frame assembly proximate to bottom portions of said uprights, said co-planar grid comprising a central support block substantially positioned at a center of said rectilinear configuration of said uprights, said central support block including a leg extending downwardly therefrom to bear upon a surface on which said frame assembly is placed, and a plurality of cross braces each extending from a respective one of said uprights to said central support block, each said cross brace being pivotally attached to said central support block and to said respective one of said uprights, wherein said frame assembly is selectively collapsible from said extended configuration to a storage configuration by vertically translating said central support block from a lower position proximate to said bottom portions of said uprights to an upper position proximate to said top portions of said uprights;

a flexible covering surrounding, along and between and in contact with said opposite sides, said frame assembly so as to form a plurality of side walls of said flexible covering in a rectilinear configuration defining an interior of said playpen having an open bottom and an open top, said flexible covering being selectively removable from said frame assembly;

a pad, separate from said flexible covering, being in contact with and supported upon said co-planar grid proximate to said bottom portions of said uprights so as to transform said open bottom of said interior of said playpen to a closed bottom of said interior of said playpen, said pad being selectively removable from said co-planar grid to enable collapsing said frame assembly from said extended configuration to said storage configuration; and a vertically-oriented central divider selectively extendable in a horizontal direction within said interior of said playpen between a pair of opposing ones of said side walls of said flexible covering and extending vertically substantially from a divider upper edge proximate to said open top to a divider lower edge proximate to said closed bottom of said interior of said playpen so as to divide said interior of said playpen into at least a pair of interior portions located adjacent to one another but at opposite sides of said central divider, each of said interior portions having a bottom surface comprised of a corresponding portion of said pad, wherein when fully extended, said central divider has a first side edge attached to a first one of said opposing sides of said flexible covering of said folding playpen, and an opposite second divider side edge attached to a second one of said opposing sides of said flexible covering of said folding playpen.

9. The folding playpen according to claim 8 wherein said frame assembly further comprises a plurality of corner supports each received at said bottom portion of a respective one of said uprights wherein each of said cross braces is pivotally affixed to a respective one of said corner supports.

10. The folding playpen according to claim 8 wherein said co-planar grid further comprises a plurality of intermediate braces, each said intermediate brace extending between adjacent ones of said cross braces intermediate between said central support block and a respective one of said uprights.

11. The folding playpen according to claim 10 wherein each said intermediate brace extending between respective adjacent ones of said cross braces is pivotally attached to said respective adjacent ones of said cross braces, and further wherein each said intermediate brace includes a central hinge such that each said intermediate brace can be selectively folded upon itself.

12. The folding playpen according to claim 8 wherein each said intermediate brace has opposite ends pivotally attached to brace fittings at respective ones of said cross braces, said brace fittings being freely translatable along a length of said cross braces.

13. The folding playpen according to claim 8 wherein said co-planar grid further comprises between each of adjacent ones of said cross braces, a secondary support block having a leg extending downwardly therefrom to bear upon the surface on which said frame assembly is placed, and a pair of intermediate support braces, a first of said intermediate support braces being pivotally attached to a first of said adjacent cross braces and said secondary support block and a second of said intermediate support braces being pivotally attached to a second of said adjacent cross braces and said secondary support block.

14. The folding playpen according to claim 13 wherein each of said first and second of said intermediate support braces at an end opposite from said secondary support block is pivotally attached to a brace fitting at a respective one of said first and second of said adjacent cross braces, said brace fittings being freely translatable along a length of said cross braces.

15. The folding playpen according to claim 8 wherein said central divider comprises a first panel affixed to a first interior side of said flexible covering and a second panel affixed to an opposite second interior side of said flexible covering, said first and said second panels being selectively attachable one to the other for dividing said interior of said playpen into at least said pair of interior portions.

16. The folding playpen according to claim 8 wherein said flexible covering is an expandable flexible mesh conformable to said extended and storage configurations of said frame assembly.

17. A folding playpen comprising:

a frame assembly in an extended configuration comprising:

a plurality of parallel uprights being spaced apart from one another and arranged in a rectilinear configuration;

a plurality of corner supports each affixed to a bottom portion of a respective one of said uprights;

a plurality of upper rails pivotally affixed to and extending between top portions of adjacent ones of said uprights so as to form a plurality of opposite sides of said frame assembly, each said upper rail including a central hinge such that each said upper rail can be selectively folded upon itself;

a co-planar grid extending between and interconnecting said opposite sides of said frame assembly proximate to said bottom portions of said uprights, said co-planar grid comprising a central support block having a leg extending downwardly therefrom to bear upon a surface on which said frame assembly is placed, said central support block substantially positioned at a center of said rectilinear configuration of said uprights, and a plurality of cross braces each extending from a respective one of said corner supports to said central support block, each said cross brace being pivotally attached to said central support block and to said respective one of said corner supports, wherein said frame assembly is selectively collapsible from said extended configuration to a storage configuration by vertically translating said central support block from a lower position proximate to said bottom portions of said uprights to an upper position proximate to said top portions of said uprights;

a flexible covering surrounding, along and between and in contact with said opposite sides, said frame assembly so as to form a plurality of side walls of said flexible covering in a rectilinear configuration defining an interior of said playpen having an open bottom and an open top, said flexible covering being selectively removable from said frame assembly;

a pad, separate from said flexible covering, being in contact with and supported by said co-planar grid proximate to said bottom portions of said uprights so as to transform said open bottom of said interior of said playpen to a closed bottom of said interior of said playpen, said pad being selectively removable from said co-planar grid to enable collapsing said frame assembly from said extended configuration to said storage configuration; and a vertically-oriented central divider selectively extendable in a horizontal direction within said interior of said playpen between a pair of opposing ones of said side walls of said flexible covering and extending vertically substantially from a divider upper edge proximate to said open top to a divider lower edge proximate to said closed bottom of said interior of said playpen so as to divide said interior of said playpen into at least a pair of interior portions located adjacent to one another but at opposite sides of said central divider, each of said interior portions having a bottom surface comprised of a corresponding portion of said pad, wherein when fully extended, said central divider has a first side edge attached to a first one of said opposing sides of said flexible covering of said folding playpen, and an opposite second divider side edge attached to a second one of said opposing sides of said flexible covering of said folding playpen.

18. The folding playpen according to claim 17 wherein said co-planar grid further comprises a plurality of intermediate braces, each said intermediate brace extending between adjacent ones of said cross braces intermediate between said central support block and a respective one of said uprights.

19. The folding playpen according to claim 18 wherein each said intermediate brace extending between respective adjacent ones of said cross braces is pivotally attached to said respective adjacent ones of said cross braces, and further wherein each said intermediate brace includes a central hinge such that each said intermediate brace can be selectively folded upon itself.

20. The folding playpen according to claim 17 wherein each said intermediate brace has opposite ends pivotally attached to brace fittings at respective ones of said cross braces, said brace fittings being freely translatable along a length of said cross braces.

21. The folding playpen according to claim 17 wherein said co-planar grid further comprises between each of adjacent ones of said cross braces, a secondary support block having a leg extending downwardly therefrom to bear upon the surface on which said frame assembly is placed, and a pair of intermediate support braces, a first of said intermediate support braces being pivotally attached to a first of said adjacent cross braces and said secondary support block and a second of said intermediate support braces being pivotally attached to a second of said adjacent cross braces and said secondary support block.

22. The folding playpen according to claim 21 wherein each of said first and second of said intermediate support braces at an end opposite from said secondary support block is pivotally attached to a brace fitting at a respective one of said first and second of said adjacent cross braces, said brace fittings being freely translatable along a length of said cross braces.

23. The folding playpen according to claim 17 wherein said central divider comprises a first panel affixed to a first interior side of said flexible covering and a second panel affixed to an opposite second interior side of said flexible covering, said first and said second panels being selectively attachable one to the other for dividing said interior of said playpen into at least said pair of interior portions.

24. The folding playpen according to claim 17 wherein said flexible covering is an expandable flexible mesh conformable to said extended and storage configurations of said frame assembly.

* * * * *